US010724241B2

(12) United States Patent
Joecken et al.

(10) Patent No.: US 10,724,241 B2
(45) Date of Patent: Jul. 28, 2020

(54) FIBER CEMENT CLADDING SYSTEM

(71) Applicant: James Hardie Technology Limited, Dublin (IE)

(72) Inventors: John Joecken, Riverside, CA (US); William J. Tinen, Trabuco Canyon, CA (US); Jared E. Kies, Perrysburg, OH (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 16/360,937

(22) Filed: Mar. 21, 2019

(65) Prior Publication Data

US 2019/0292786 A1 Sep. 26, 2019

Related U.S. Application Data

(60) Provisional application No. 62/646,836, filed on Mar. 22, 2018.

(51) Int. Cl.
*E04F 13/14* (2006.01)
*E04D 1/16* (2006.01)
(Continued)

(52) U.S. Cl.
CPC ..... *E04D 1/16* (2013.01); *B28B 1/52* (2013.01); *B44F 9/02* (2013.01); *E04D 1/265* (2013.01); *E04F 13/0871* (2013.01); *E04F 13/14* (2013.01)

(58) Field of Classification Search
CPC ... E04D 1/16; E04D 1/265; B28B 1/52; E04F 13/14; E04F 13/0871; E04F 13/147; E04F 13/148; B44F 9/02
See application file for complete search history.

(56) References Cited

U.S. PATENT DOCUMENTS 3,608,261 A 9/1971 French et al.
4,261,152 A 4/1981 Hayes
(Continued)

FOREIGN PATENT DOCUMENTS

EP 0908578 A2 4/1999

OTHER PUBLICATIONS

Search Report in European Application No. 19164609.0 dated Aug. 9, 2019 in 4 pages.

(Continued)

*Primary Examiner* — Patrick J Maestri
(74) *Attorney, Agent, or Firm* — Knobbe, Martens, Olson & Bear, LLP

(57) ABSTRACT

Disclosed herein is a fiber cement cladding system such as fiber cement shingles or shakes which can have the appearance of authentic wood. Each individual fiber cement shingle or shake comprises a textured surface having a depth of relief and a coating system disposed on the textured surface. The coating system may include a sealing agent, a basecoat, and a topcoat. In some embodiments, the basecoat is disposed on at least a portion of the sealing agent and the topcoat is disposed on at least a portion of the basecoat. In some embodiments, the basecoat comprises a DFT of 1 to 3 mils and the topcoat comprises a DFT of 0.05 to 2 mils. In some embodiments, the depth of relief of the textured surface of the fiber cement shingle is about 0.045" to 0.085".

20 Claims, 10 Drawing Sheets

(51) Int. Cl.

| | |
|---|---|
| ***E04D 1/26*** | (2006.01) |
| ***B28B 1/52*** | (2006.01) |
| ***B44F 9/02*** | (2006.01) |
| ***E04F 13/08*** | (2006.01) |

(56) References Cited

U.S. PATENT DOCUMENTS

| | | | | |
|---|---|---|---|---|
| 4,955,169 | A | 9/1990 | Shisko | |
| 5,362,881 | A | 11/1994 | Leistner et al. | |
| 7,155,866 | B2 * | 1/2007 | Bezubic, Jr. | B28B 1/526 52/287.1 |
| 2005/0210811 | A1 * | 9/2005 | Nasvik | E04F 13/147 52/596 |
| 2007/0110981 | A1 * | 5/2007 | Killilea | C04B 41/009 428/294.7 |
| 2007/0282046 | A1 * | 12/2007 | Killilea | C09D 133/02 524/261 |
| 2008/0199725 | A1 | 8/2008 | Vetter et al. | |
| 2008/0263985 | A1 | 10/2008 | Hasch et al. | |
| 2012/0028071 | A1 * | 2/2012 | Lyubomirskiy | E04F 13/0871 428/600 |
| 2012/0034485 | A1 * | 2/2012 | Lyubomirskiy | B44C 1/227 428/600 |
| 2012/0040204 | A1 * | 2/2012 | Lyubomirskiy | B44C 1/227 428/600 |
| 2012/0251787 | A1 | 10/2012 | Mizuno | |
| 2016/0040436 | A1 | 2/2016 | Grau | |
| 2016/0060878 | A1 | 3/2016 | Everhart, II et al. | |
| 2017/0073543 | A1 * | 3/2017 | Joecken | C04B 41/71 |

OTHER PUBLICATIONS

Communication Pursuant to Article 94(3) EPC in European Application No. 19164609.0 dated Mar. 9, 2020 in 5 pages.

* cited by examiner

500B

FIBER CEMENT CLADDING SYSTEM

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure generally relates to fiber cement cladding systems such as fiber cement shingles, shakes, or half rounds, and methods for manufacturing the same.

Description of the Related Art

Wood shingles are generally rectangular shaped tiles that can be used as cladding material to cover the roof or exterior wall of a building structure. They are usually laid in courses on the roof or exterior wall of the building structure. Due to fire risks, many wood shingles are being replaced by alternative materials such as asphalt or fiber cement shingles. It is however difficult to replicate the overall appearance of installed courses of cedar or other natural wood shingles on a building structure when using non-wood shingles. Installed non-wood shingles tend to look fake and man-made even if they are painted in a brownish color to resemble wood.

It is particularly difficult to simulate the natural variability and aesthetics associated with cedar shingles using fiber cement as the substrate. Due to the manufacturing process and equipment used to make fiber cement, the texture pattern is sometimes considered to be overly uniform and consistent, considered to lack the three dimensional imperfections of sawn cut wood, and considered to present a monochromatic appearance when painted. Existing fiber cement shingles typically have a manufactured, flat appearance with minimal wood grain visibility or color gradation. However, copying the exact wood grain pattern from a natural cedar shingle will not necessarily result in a fiber cement shingle with the same natural wood appearance because the pattern has to be embossed when the fiber cement is in wet green-sheet form, which often causes the pattern to become distorted and blurred.

In view of the foregoing, there is a need for an improved fiber cement shingle system that creates the natural appearance of sawn cut wood when the shingles are laid in courses on a building structure.

SUMMARY

The systems, methods, and devices described herein address one or more problems as described above and associated with existing construction systems and methods. The systems, methods and devices described herein have innovative aspects, no single one of which is indispensable or solely responsible for their desirable attributes. Without limiting the scope of the claims, the summary below describes some of the advantageous features.

In one embodiment, a fiber cement shingle system that provides the appearance that individual fiber cement shingles are each sawn or cut from natural wood. The individual fiber cement shingles have varied texture and color simulating the variations present in natural sawn or cut wood. Each fiber cement shingle comprises a textured surface having a texture and depth of relief selected to combine synergistically with preselected coating composition such that reflection of light and the color difference from shingle to shingle is randomized within certain controlled parameters.

In one embodiment, a cladding system configured to be installed in courses on an exterior of a building structure is disclosed. The cladding system comprises a plurality of fiber cement shingles. The plurality of fiber cement shingles comprise: a first fiber cement shingle comprising a first fiber cement substrate, said first fiber cement substrate having a textured surface comprising a circular saw mark pattern, wherein the textured surface has a depth of relief ranging from 0.045 inch (1.143 mm) to 0.085 inch (2.159 mm); a second fiber cement shingle comprising a second fiber cement substrate, said second fiber cement substrate having a textured surface comprising raised fibers, wherein the textured surface has a depth of relief ranging from 0.045 inch (1.143 mm) to 0.085 inch (2.159 mm); a third fiber cement shingle comprising a third fiber cement substrate, said third fiber cement substrate having a textured surface comprising straight or edge grain, wherein the textured surface has a depth of relief ranging from 0.045 inch (1.143 mm) to 0.085 inch (2.159 mm); and a fourth fiber cement shingle comprising a fourth fiber cement substrate, said fourth fiber cement substrate having a textured surface comprising flat or open cathedrals, wherein the textured surface has a depth of relief ranging from 0.045 inch (1.143 mm) to 0.085 inch (2.159 mm). The cladding system further comprises a coating system disposed on the textured surface of each of the fiber cement substrates of the fiber cement shingles. The coating system comprises: a sealing agent, the sealing agent comprising a two-part waterborne epoxy sealer; a basecoat disposed on a portion of the sealing agent, the basecoat comprising a first Dry Film Thickness (DFT) between 1 to 3 mils; and a topcoat disposed on a portion of the basecoat. The topcoat comprises: a second Dry Film Thickness (DFT) between 0.5 to 1.5 mils, wherein the second DFT of the topcoat is smaller than the first DFT of the basecoat, and wherein the topcoat enhances the basecoat and textured surface. The depth of relief on each of the fiber cement substrates in combination with the coating system causes the fiber cement shingles to have varied color values within the same fiber cement shingle and between one or more different fiber cement shingles. In some embodiments, the topcoat is semi-transparent.

In some embodiments, the circular saw mark pattern comprises one or more circular saw marks having a diameter between 42" (106.68 cm) and 46" (116.84 cm).

In some embodiments, the first DFT of the basecoat is between 1.70 to 1.80 mil and the second DFT of the topcoat is between 0.70 to 0.80 mil.

In some embodiments, each of the plurality of fiber cement shingles comprises a CIELAB color value, at least two of the plurality of fiber cement shingles comprising different CIELAB color values, and wherein the difference dE is between 3 and 10.

In some embodiments, the basecoat of each of the plurality of fiber cement shingles comprises an L value between 67 and 77, an a value between −0.50 and 0.8, and a b value between 2.0 and 3.1, the topcoat of each of the plurality of fiber cement shingles comprises an L value between 61 and 75, an a value between −2.0 and −0.2, and a b value between 0.5 and 2.0, and the plurality of fiber cement shingles are configured to replicate the appearance of Eastern grey cedar wood shingles.

In some embodiments, the basecoat of each of the plurality of fiber cement shingles comprises an L value between 44 and 64, an a value between 10 and 13, and a b value between 18 and 25, the topcoat of each of the plurality of fiber cement shingles comprises an L value between 39 and 50, an a value between 7.0 and 22.0, and a b value between 11 and 29, and wherein the plurality of fiber cement shingles are configured to replicate the appearance of Western red cedar wood shingles.

In some embodiments, the basecoat has a weight percent non-volatile material (NVM) of between 50 and 60 percent and the topcoat has a weight percent non-volatile material (NVM) of between 40 and 50 percent.

In some embodiments, the topcoat further comprises a UV absorber and a Hindered Amine Light Stabilizer (HALS) additive.

In another embodiment, a cladding shingle configured to replicate the appearance of a natural wood shingle is disclosed. The cladding shingle comprises a fiber cement substrate and further comprises: a textured surface, the textured surface comprising a wood grain pattern having a depth of relief ranging from 0.045" to 0.085"; and a coating system disposed on the textured surface. The coating system comprises: a sealing agent, the sealing agent comprising a two-part waterborne epoxy sealer; a basecoat disposed on a portion of the sealing agent; and a topcoat disposed on a portion of the basecoat. The basecoat comprises: a Dry Film Thickness (DFT) between 1 to 3 mils; and a first CIELAB color value comprising a first L value, a first a value, and a first b value. The topcoat comprises: a Dry Film Thickness (DFT) between 0.5 to 1.5 mils, wherein the DFT of the topcoat is smaller than the DFT of the basecoat; a second CIELAB color value comprising a second L value, a second a value, and a second b value; a UV absorber; and a Hindered Amine Light Stabilizer (HALS). The first CIELAB color value of the basecoat and the second CIELAB color value of the topcoat differ by a difference dE and the first L value of the basecoat is greater than the second L value of the topcoat.

In some embodiments, the wood grain pattern comprises circular saw marks.

In some embodiments, the circular saw marks have a diameter between 42" (106.68 cm) and 46" (116.84 cm).

In some embodiments, the DFT of the basecoat is between 1.70 to 1.80 mil and the DFT of the topcoat is between 0.70 to 0.80 mil.

In some embodiments, the difference between the first CIELAB color value of the basecoat and the second CIELAB color value of the topcoat is between 3 and 7, and wherein: the first L value is between 67 and 77 and the second L value is between 61 and 75, the first L value being greater than the second L value; the first a value is between −0.5 and 1.0 and the second a value is between −2.0 and −0.2; and the first b value is between 2.0 and 3.0 and the second b value is between 0.5 and 2.0; wherein the cladding shingle at least partially replicates the appearance of an Eastern grey cedar wood shingle.

In some embodiments, the basecoat has a weight percent non-volatile material (NVM) of between 50 and 60 percent and the topcoat has a weight percent non-volatile material (NVM) of between 40 and 50 percent.

In another embodiment, a building article having an appearance of wood is disclosed. The building article comprises a fiber cement substrate having a textured surface and a coating system disposed on the textured surface, wherein the textured surface comprises a depth of relief, the depth of relief ranging from 0.010" (0.254 mm) to 0.300" (7.62 mm). The coating system comprises a basecoat and a topcoat. The basecoat comprises: a first Dry Film Thickness (DFT) between 1 to 3 mils; and a first CIELAB color value comprising a first L value, a first a value, and a first b value. The topcoat comprises: a second Dry Film Thickness (DFT) between 0.5 to 1.5 mils, wherein the second DFT of the topcoat is smaller than the first DFT of the basecoat; and a second CIELAB color value comprising a second L value, a second a value, and a second b value. The first CIELAB color value of the basecoat and the second CIELAB color value of the topcoat differ by a difference dE, and wherein the first L value of the basecoat is greater than the second L value of the topcoat. In some embodiments, the topcoat is semi-transparent.

In some embodiments, the textured surface of the fiber cement building article comprises a textured pattern, the textured pattern comprising circular saw marks.

In some embodiments, the coating system further comprises a sealing agent, the sealing agent comprising a two-part waterborne epoxy sealer.

In some embodiments, the topcoat further comprises at least one of a UV absorber or a Hindered Amine Light Stabilizer (HALS) additive. In some embodiments, the topcoat is semi-transparent.

In some embodiments, the basecoat has a weight percent non-volatile material (NVM) of between 40 and 70 percent and the topcoat has a weight percent non-volatile material (NVM) of between 30 and 60 percent, and wherein the NVM of the basecoat is larger than the NVM of the topcoat.

In some embodiments, the building article is a shingle.

In some embodiments, the fiber cement shingle comprises a fiber cement substrate comprising a textured surface having a depth of relief and a coating system disposed on the textured surface; wherein the coating system comprises a sealing agent layer, a basecoat layer and a topcoat layer; a basecoat disposed on at least a portion of the sealing agent, said basecoat having a DFT of 1 to 3 mils; a topcoat disposed on at least a portion of the basecoat, said topcoat having a DFT of 0.05 to 2 mils; and wherein the textured surface has a depth of relief of about 0.045" to 0.085".

In another embodiment, a set of fiber cement shingles for installation to a common building substrate is described. The set comprises a plurality of fiber cement shingles such as those described above, wherein at least two of the fiber cement shingles comprise different texture patterns such as circular saw marks; raised fibers; straight or edge grain; and flat or open cathedrals; or combinations thereof; and at least two of the fiber cement shingles have different CIELAB total color values E, the E values of any two fiber cement shingles differing by a difference dE.

In some embodiments, the fiber cement shingles system comprises a plurality of different textured patterns such as circular saw marks; raised fibers; straight or edge grain; and flat or open cathedrals; or a combination thereof. In some embodiments, the sealing agent comprises an epoxy silane resin. In some embodiments, the basecoat has an L value of from about 75.38 to 77.38, an a value of from about −0.77 to about 1.23, and a b value of from about 1.51 to about 3.51. In some embodiments, the topcoat has an L value of from about 72.70 to about 74.70, an a value of from about −2.27 to about −0.27, and a b value ranging from about 0.46 to about 2.46. In some embodiments, the basecoat has an L value of from about 71.38 to about 73.38, an a value of from about −0.77 to about 1.23, and a b value of from about 1.51 to about 3.51. In some embodiments, the topcoat has an L value of from about 65.35 to about 67.35, an a value of from about −1.78 to about 0.22, and a b value ranging from about 0.16 to about 2.16. In some embodiments, the basecoat has an L value of from about 67.38 to about 69.38, an a value of from about −0.77 to about 1.23, and a b value of from about 1.51 to about 3.51. In some embodiments, the topcoat has an L value of from about 61.34 to about 63.34, an a value of from about −1.77 to about 0.23, and a b value of about 0.07 to about 2.07. In some embodiments, the basecoat has an L value of from 61.81 to about 63.81, an a value of from about 11.35 to about 13.35, and a b value of from about 22.79 to about 24.79. In some embodiments, the topcoat has an L value of from about 47.44 to about 49.44, an a value of from about 20.20 to about 22.20, and a b value ranging from about 27.01 to about 29.01. In some embodiments, the basecoat has an L value of from about 54.99 to about 56.99, an a value of from about 10.78 to about 12.78, and a b value of from about 18.71 to about 20.71. In some embodiments, the topcoat has an L value of from about 45.42 to about 47.42, an a value of from about 17.87 to about 19.87, and a b value ranging from about 24.42 to about 26.42. In some embodiments, the basecoat has an L value of from about 43.97 to about 45.97, an a value of from about 10.00 to about 12.00, and a b value of from about 18.00 to about 20.00. In some embodiments, the topcoat has an L value of from about 39.39 to about 41.39, an a value of from about 6.65 to about 8.65, and a b value ranging from about 11.51 to about 13.51. In some embodiments, the basecoat has a DFT of 1.70 to 1.80 mil. In some embodiments, the topcoat has a DFT of 0.70 to 0.80 mil. In some embodiments, each of the sealing agent, the basecoat and the topcoat further comprises at least one of a UV absorber or a Hindered Amine Light Stabilizer (HALS) additive. In some embodiments, the UV absorber comprises a UV absorber based on 2-hydroxyphenyl-benzophenone, 2-(2-hydroxyphenyl)benzotriazole or 2-hydroxyphenyl-s-triazine. In some embodiments, the HALS comprises a di- or oligo-functional HALS based on a tetramethylpiperidine derivative.

In some embodiments, the maximum dE between any two of the fiber cement shingles is between 5 and 7. In some embodiments, the maximum dE between any two of the fiber cement shingles is approximately 6. In some embodiments, the maximum dE between any two of the fiber cement shingles is not greater than 6. In some embodiments, the minimum dE between any two of the fiber cement shingles having different E values is between 1.5 and 2.5. In some embodiments, the minimum dE between any two of the fiber cement shingles having different E values is approximately 2. In some embodiments, at least two of the fiber cement shingles comprise different CIELAB total color values E and yet has the same texture pattern such as circular saw marks; raised fibers; straight or edge grain; and flat or open cathedrals. In some embodiments, at least two of the fiber cement shingles comprise the same CIELAB total color value E and yet have different texture patterns such as circular saw marks; raised fibers; straight or edge grain; and flat or open cathedrals; or a combination thereof.

In another embodiment, a coating system for fiber cement cladding shingles comprising a depth of relief is described. The coating system comprises a textured surface having a depth of relief. The coating system comprises a sealing agent; a basecoat disposed on at least a portion of the sealing agent, said basecoat having a DFT of 1 to 3 mils; a topcoat disposed on at least a portion of the basecoat, said topcoat having a DFT of 0.05 to 2 mils; and wherein the textured surface has a depth of relief of about 0.045" to 0.085".

In some embodiments, the fiber cement shingle comprises a textured surface selected from the group consisting of circular saw marks; raised fibers; straight or edge grain; and flat or open cathedrals; or a combination thereof. In some embodiments, the sealing agent comprises an epoxy silane resin. In some embodiments, the basecoat has an L value of from about 75.38 to 77.38, an a value of from about −0.77 to about 1.23, and a b value of from about 1.51 to about 3.51. In some embodiments, the topcoat has an L value of from about 72.70 to about 74.70, an a value of from about −2.27 to about −0.27, and a b value ranging from about 0.46 to about 2.46. In some embodiments, the basecoat has an L value of from about 71.38 to about 73.38, an a value of from about −0.77 to about 1.23, and a b value of from about 1.51 to about 3.51. In some embodiments, the topcoat has an L value of from about 65.35 to about 67.35, an a value of from about −1.78 to about 0.22, and a b value ranging from about 0.16 to about 2.16. In some embodiments, the basecoat has an L value of from about 67.38 to about 69.38, an a value of from about −0.77 to about 1.23, and a b value of from about 1.51 to about 3.51. In some embodiments, the topcoat has an L value of from about 72.70 to about 74.70, an a value of from about −2.27 to about −0.27, and a b value of about 0.46 to about 2.46. In some embodiments, the basecoat has an L value of from 61.81 to about 63.81, an a value of from about 11.35 to about 13.35, and a b value of from about 22.79 to about 24.79. In some embodiments, the topcoat has an L value of from about 47.44 to about 49.44, an a value of from about 20.20 to about 22.20, and a b value ranging from about 27.01 to about 29.01. In some embodiments, the basecoat has an L value of from about 54.99 to about 56.99, an a value of from about 10.78 to about 12.78, and a b value of from about 18.71 to about 20.71. In some embodiments, the topcoat has an L value of from about 45.42 to about 47.42, an a value of from about 17.87 to about 19.87, and a b value ranging from about 24.42 to about 26.42. In some embodiments, the basecoat has an L value of from about 43.97 to about 45.97, an a value of from about 10.00 to about 12.00, and a b value of from about 18.00 to about 20.00. In some embodiments, the topcoat has an L value of from about 39.39 to about 41.39, an a value of from about 6.65 to about 8.65, and a b value ranging from about 11.51 to about 13.51. In some embodiments, the basecoat has a DFT of 1.70 to 1.80 mil. In some embodiments, the topcoat has a DFT of 0.70 to 0.80 mil. In some embodiments, each of the sealing agent, the basecoat and the topcoat further comprises at least one of a UV absorber or a Hindered Amine Light Stabilizer (HALS). In some embodiments, the UV absorber comprises a UV absorber based on 2-hydroxyphenyl-benzophenone, 2-(2-hydroxyphenyl)benzotriazole or 2-hydroxyphenyl-s-triazine. In some embodiments, the HALS comprises a di- or oligo-functional HALS based on a tetramethylpiperidine derivative.

In another embodiment, a method of manufacturing a coated fiber cement article having the appearance of wood is described. The method comprises the steps of: (a) providing a fiber cement substrate with a wood grain texture pattern having a depth of relief on at least one surface; (b) applying at least one coat of a sealing agent to at least a portion of the surface having a wood grain texture; (c) at least partially curing the sealing agent to form a sealing agent layer; then (d) applying at least one coat of a basecoat to at least a portion of the at least partially cured sealing agent layer; (e) at least partially curing the basecoat to form a basecoat layer; then (f) applying at least one coat of a topcoat; and (g) at least partially curing the topcoat to form a topcoat.

In some embodiments, the fiber cement substrate comprises a textured pattern selected from the group consisting of circular saw marks; raised fibers; straight or edge grain; and flat or open cathedrals; or a combination thereof. In some embodiments, the sealing agent comprises an epoxy silane resin. In some embodiments, the basecoat has an L value of from about 75.38 to 77.38, an a value of from about −0.77 to about 1.23, and a b value of from about 1.51 to about 3.51. In some embodiments, the topcoat has an L value of from about 72.70 to about 74.70, an a value of from about −2.27 to about −0.27, and a b value ranging from about 0.46 to about 2.46. In some embodiments, the basecoat has an L value of from about 71.38 to about 73.38, an a value of from about −0.77 to about 1.23, and a b value of from about 1.51 to about 3.51. In some embodiments, the topcoat has an L value of from about 65.35 to about 67.35, an a value of from about −1.78 to about 0.22, and a b value ranging from about 0.16 to about 2.16. In some embodiments, the basecoat has an L value of from about 67.38 to about 69.38, an a value of from about −0.77 to about 1.23, and a b value of from about 1.51 to about 3.51. In some embodiments, the topcoat has an L value of from about 72.70 to about 74.70, an a value of from about −2.27 to about −0.27, and a b value of about 0.46 to about 2.46. In some embodiments, the basecoat has an L value of from 61.81 to about 63.81, an a value of from about 11.35 to about 13.35, and a b value of from about 22.79 to about 24.79. In some embodiments, the topcoat has an L value of from about 47.44 to about 49.44, an a value of from about 20.20 to about 22.20, and a b value ranging from about 27.01 to about 29.01. In some embodiments, the basecoat has an L value of from about 54.99 to about 56.99, an a value of from about 10.78 to about 12.78, and a b value of from about 18.71 to about 20.71. In some embodiments, the topcoat has an L value of from about 45.42 to about 47.42, an a value of from about 17.87 to about 19.87, and a b value ranging from about 24.42 to about 26.42. In some embodiments, the basecoat has an L value of from about 43.97 to about 45.97, an a value of from about 10.00 to about 12.00, and a b value of from about 18.00 to about 20.00. In some embodiments, the topcoat has an L value of from about 39.39 to about 41.39, an a value of from about 6.65 to about 8.65, and a b value ranging from about 11.51 to about 13.51. In some embodiments, the basecoat has a DFT of 1.70 to 1.80 mil. In some embodiments, the topcoat has a DFT of 0.70 to 0.80 mil. In some embodiments, each of the sealing agent, the basecoat and the topcoat further comprises at least one of a UV absorber or a Hindered Amine Light Stabilizer (HALS). In some embodiments, the UV absorber comprises a UV absorber based on 2-hydroxyphenyl-benzophenone, 2-(2-hydroxyphenyl)benzotriazole or 2-hydroxyphenyl-s-triazine. In some embodiments, the HALS comprises a di- or oligo-functional HALS based on a tetramethylpiperidine derivative.

In another embodiment, a coated fiber cement article having the appearance of wood is described. The coated fiber cement article comprises a fiber cement article comprising a textured surface having a depth of relief, and a coating system disposed on the textured surface; wherein the coating system comprises a sealing agent layer, a basecoat layer and a topcoat layer; a basecoat disposed on at least a portion of the sealing agent, said basecoat having a DFT of 1 to 3 mils; a topcoat disposed on at least a portion of the basecoat, said topcoat having a DFT of 0.05 to 2 mils; and wherein the textured surface has a depth of relief of about 0.045" to 0.085".

In some embodiments, the fiber cement article comprises a textured pattern selected from the group consisting of circular saw marks; raised fibers; straight or edge grain; and flat or open cathedrals; or a combination thereof. In some embodiments, the sealing agent comprises an epoxy silane resin. In some embodiments, the basecoat has an L value of from about 75.38 to 77.38, an a value of from about −0.77 to about 1.23, and a b value of from about 1.51 to about 3.51. In some embodiments, the topcoat has an L value of from about 72.70 to about 74.70, an a value of from about −2.27 to about −0.27, and a b value ranging from about 0.46 to about 2.46. In some embodiments, the basecoat has an L value of from about 71.38 to about 73.38, an a value of from about −0.77 to about 1.23, and a b value of from about 1.51 to about 3.51. In some embodiments, the topcoat has an L value of from about 65.35 to about 67.35, an a value of from about −1.78 to about 0.22, and a b value ranging from about 0.16 to about 2.16. In some embodiments, the basecoat has an L value of from about 67.38 to about 69.38, an a value of from about −0.77 to about 1.23, and a b value of from about 1.51 to about 3.51. In some embodiments, the topcoat has an L value of from about 72.70 to about 74.70, an a value of from about −2.27 to about −0.27, and a b value of about 0.46 to about 2.46. In some embodiments, the basecoat has an L value of from 61.81 to about 63.81, an a value of from about 11.35 to about 13.35, and a b value of from about 22.79 to about 24.79. In some embodiments, the topcoat has an L value of from about 47.44 to about 49.44, an a value of from about 20.20 to about 22.20, and a b value ranging from about 27.01 to about 29.01. In some embodiments, the basecoat has an L value of from about 54.99 to about 56.99, an a value of from about 10.78 to about 12.78, and a b value of from about 18.71 to about 20.71. In some embodiments, the topcoat has an L value of from about 45.42 to about 47.42, an a value of from about 17.87 to about 19.87, and a b value ranging from about 24.42 to about 26.42. In some embodiments, the basecoat has an L value of from about 43.97 to about 45.97, an a value of from about 10.00 to about 12.00, and a b value of from about 18.00 to about 20.00. In some embodiments, the topcoat has an L value of from about 39.39 to about 41.39, an a value of from about 6.65 to about 8.65, and a b value ranging from about 11.51 to about 13.51. In some embodiments, the basecoat has a DFT of 1.70 to 1.80 mil. In some embodiments, the topcoat has a DFT of 0.70 to 0.80 mil. In some embodiments, each of the sealing agent, the basecoat and the topcoat further comprises at least one of a UV absorber or a Hindered Amine Light Stabilizer (HALS). The UV absorber comprises a UV absorber based on 2-hydroxyphenyl-benzophenone, 2-(2-hydroxyphenyl) benzotriazole or 2-hydroxyphenyl-s-triazine. In some embodiments, the HALS comprises a di- or oligo-functional HALS based on a tetramethylpiperidine derivative.

DETAILED DESCRIPTION

Figure 1A:
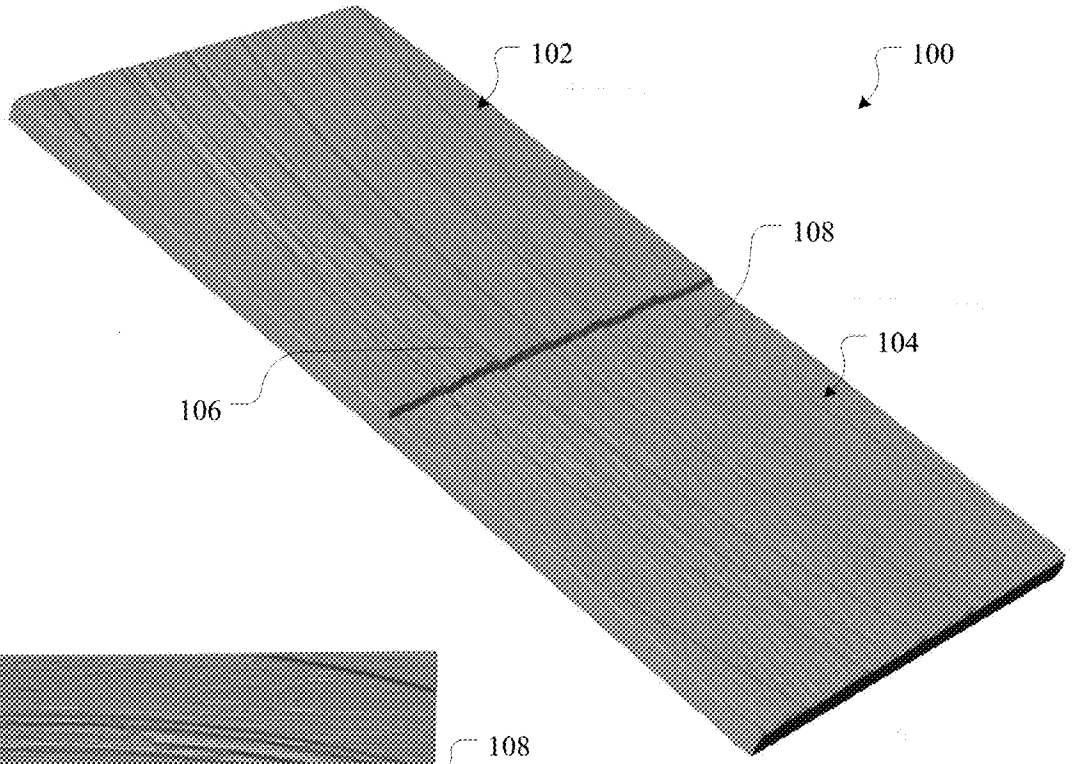
FIGS. 1A-1D depict a fiber cement article in accordance with one embodiment of the present disclosure.
Figure 1B:
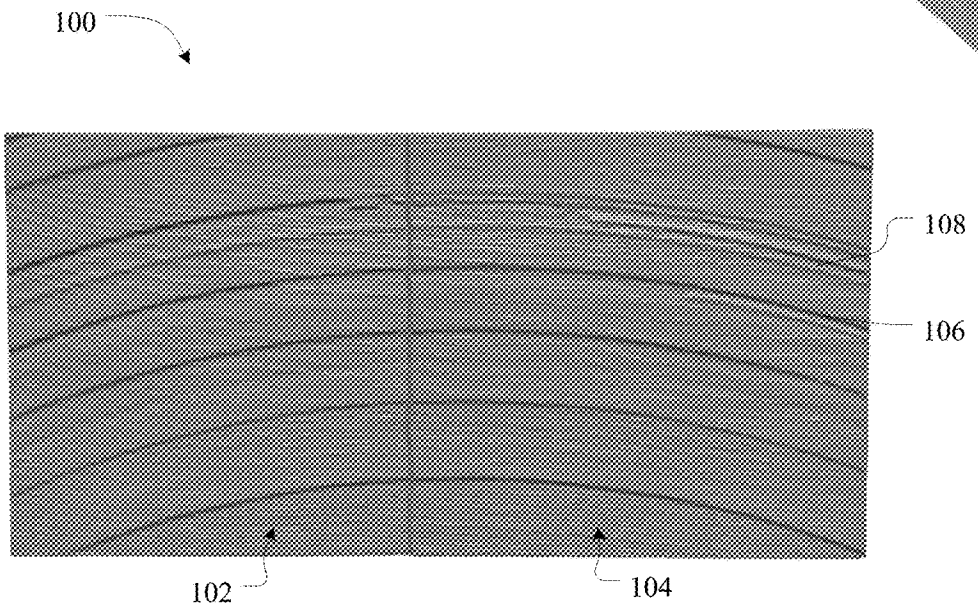
Figure 1C:
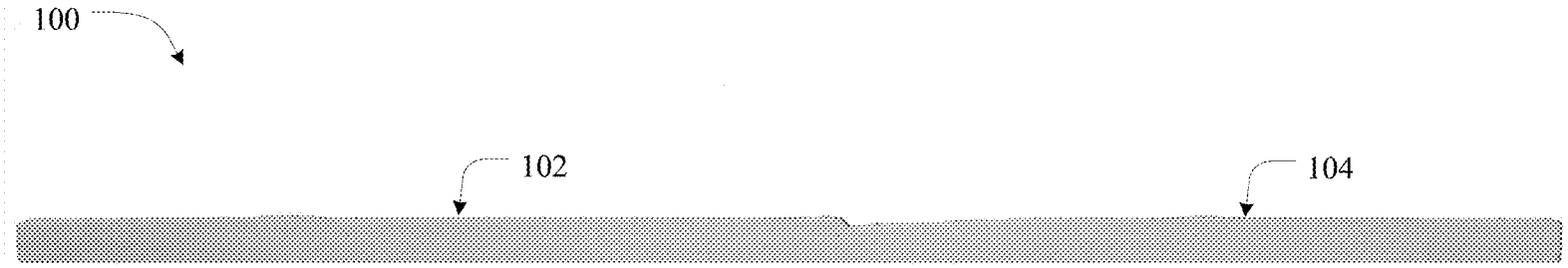
Figure 1D:
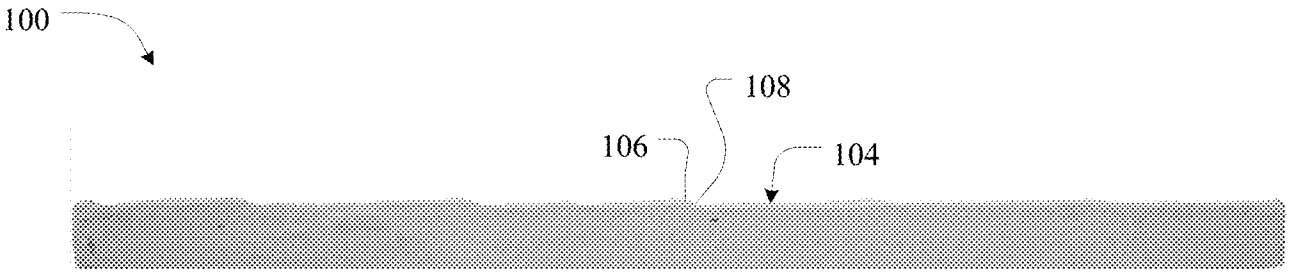

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be used, and other changes may be made, without departing from the spirit or scope of the subject matter presented here. It will be readily understood that the embodiments of the present disclosure, as generally described herein, and illustrated in the figures, can be arranged, substituted, combined, and designed in a wide variety of different configurations, all of which are explicitly contemplated and made part of this disclosure.

Generally described, the present disclosure provides a combination of texture patterns and coating compositions that together create the natural appearance of sawn cut wood. In some embodiments, the coated cementitious article has the appearance of sawn cut cedar wood. For example, the coated fiber cement article may have the appearance of sawn cut western red cedar, sawn cut eastern grey cedar, or other varieties.

The cementitious articles may be prepared with a complementary set of three-dimensional textured patterns to replicate wood-like patterns. For example, in some embodiments, the fiber cement articles may have patterns including, but not limited to, grain with circular saw marks, straight or vertical grain, raised fibers and open flat grain called cathedrals. In some embodiments, the diameter of the circular saw marks are in the range of 42"-46" which can be replicated by the fiber cement embossing process and impart the appearance of natural sawn cut cedar shingles.

Tinted basecoats and topcoats are designed to be applied to a fiber cement article with the wood like texture patterns to highlight certain areas of the texture patterns so that the shingle looks like stained wood with varied colors. These highlights may be created and/or enhanced by the depth of these patterns, which may range from about 0.045" to about 0.085". In some embodiments, the basecoat and topcoat colors can be designed to reproduce the inherent colors in natural cedar wood, to provide visual color variation, and/or to accentuate the texture patterns. In some embodiments, the topcoat colors can be designed to enhance the underlying basecoat colors and can be tailored to provide certain visual characteristics of cedar wood such as dark black patches or streaks of red tannin.

In some embodiments, the fiber cement article may be coated with a primer. In some embodiments, a two-part waterborne epoxy sealer may be used as a primer for the basecoat/topcoat coating system to impart weathering, appearance, and durability. Two-part waterborne epoxy sealers may be used, for example, if one-part waterborne acrylic primers do not give acceptable durability, paint adhesion, or final appearance. The basecoat and topcoat paints may be acrylic heat cured paints, which can be applied as factory finishes to achieve the desired paint durability, adhesion and final appearance characteristics of natural cedar wood.

In some embodiments, the overall coating system comprises a combination of the new cementitious article patterns with specifically designed basecoat and topcoat paint systems applied to them. In some embodiments, the waterborne coating system application process comprises: (1) application of a two-part waterborne epoxy sealer; (2) application of one or more solid basecoats; and (3) application of one or more topcoats. In some embodiments, the basecoat and topcoat colors are designed to simulate the appearance of natural wood including, but not limited to, eastern grey cedar and western red cedar. In some embodiments, the topcoat is transparent or semi-transparent. In some embodiments, the topcoat is non-transparent.

In order to produce the natural look of cedar wood on a fiber cement article, both the texture pattern and the coating color system can be implemented in combination to create fiber cement shingle that looks like cedar wood shingle. The basecoat colors described herein are designed to match the majority of the natural cedar wood colors. For example, in some embodiments, the basecoat is light grey in color. In some embodiments, the basecoat is a medium grey in color. In some embodiments, the basecoat is dark grey in color. In some embodiments, the basecoat is light tan in color. In some embodiments, the basecoat is medium tan in color. In some embodiments, the basecoat is dark brown in color. Two or more of these basecoats may be combined to produce additional color configurations. In some embodiments, a fiber cement article comprises one basecoat and one topcoat. In some embodiments, a fiber cement article comprises one or more basecoats (such as two or three basecoats) and/or one or more topcoats.

In some embodiments, a set of shingles (e.g., a bundle, system, kit, etc.) may include a randomized or pseudo-randomized assortment of shingle texture patterns and/or colors which may be installed such that many or most adjacent shingles differ in color, texture, or both. For example, the set of shingles may include two, three, four, or more colors, some or all of which may be applied to the shingles such that each of the texture patterns is included in a plurality of different colors. In the set of shingles, shingles with the same texture pattern may have different colors or different shades of the same color. Accordingly, the combinations of colors and texture patterns described herein may advantageously create a more natural look when installed and avoid from appearing overly uniform or forming any discernible patterns characteristic of man-made shingles.

Cementitious Article Texture Patterns

As described above, a variety of texture patterns may be incorporated into a set of shingles to impart the appearance of natural sawn cut wood, both in individual shingles and in an assortment of shingles for installation. The new patterns include circular saw marks (for example, with a diameter of 42" to 46" (106.68 cm to 116.84 cm, corresponding to a radius of curvature of 21" to 23", or 53.34 cm to 58.42 cm)), raised fibers that follow grain lines, straight or edge grain, and flat or open cathedrals. The depths of the texture patterns may vary. For example, in some embodiments the texture depth (also referred to herein as the "depth of relief") ranges from 0.045" to 0.085" (1.143 mm to 2.159 mm). These four different textures are designed to create a varied reflection, such as in sunlight or artificial light, for a painted cedar look when coated with paint color. However, the new texture pattern shingle alone may not necessarily give the desired stained eastern or western cedar look with conventional paints. Thus, the novel coatings described herein below may be applied as well in combination with these texture patterns to produce a high-quality stained cedar look.

With reference to FIGS. 1A-5B, shingles with textured patterns and coating systems designed to replicate natural cedar shingles will now be described in greater detail. FIGS. 1A-1D depict an example shingle 100 with a circular saw mark texture. FIG. 1A is a perspective view of the shingle 100, FIG. 1B is a front elevation view, FIG. 1C is a left side profile view, and FIG. 1D is a bottom plan view of the shingle 100. The shingle 100 is generally defined by an upper section 102 and a lower section 104 disposed below the upper section 102 when the shingle 100 is installed vertically against a building substrate. The shingle 100 includes a variety of peak areas 106 and valley areas 108 arranged in a shape approximating a series of circular saw marks. As shown in FIG. 1D, the shingle 100 has a thickness at the peak areas 106 that is greater than a thickness of the shingle 100 at the valley areas 108. A difference between the thickness of the shingle 100 at the peak areas 106 and the thickness of the shingle 100 at the valley areas 108 can range from 0.045" to 0.085" (1.143 mm to 2.159 mm), for example, although differences outside these values or ranges are possible in some cases. In one embodiment, each of the circular saw marks has a radius of 21"-23". The shingle 100 may comprise any cementitious material with or without fiber reinforcement, or other suitable cladding material, such as vinyl, a composite material, wood-based material, or the like. For example, the shingle 100 can comprise fiber cement.

Figure 2A:
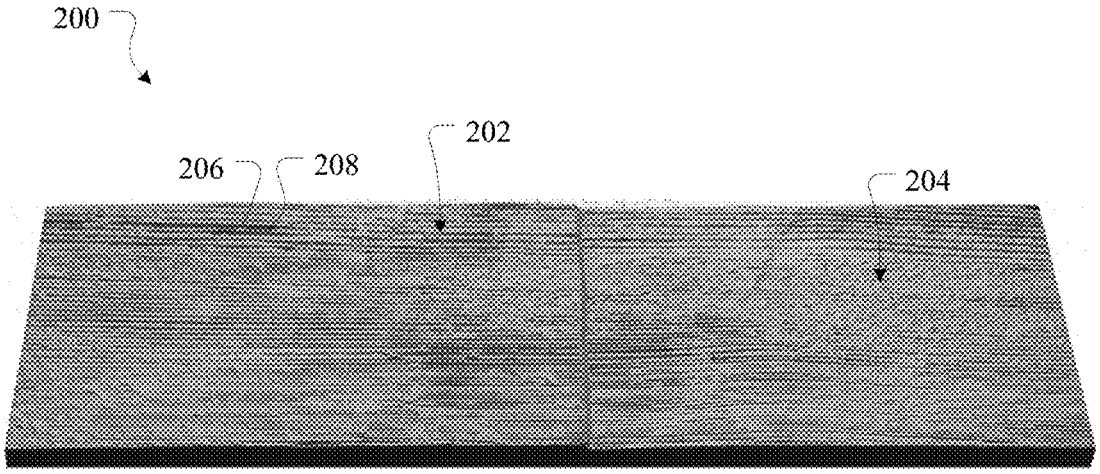
FIGS. 2A-2D depict a fiber cement article in accordance with one embodiment of the present disclosure.
Figure 2B:
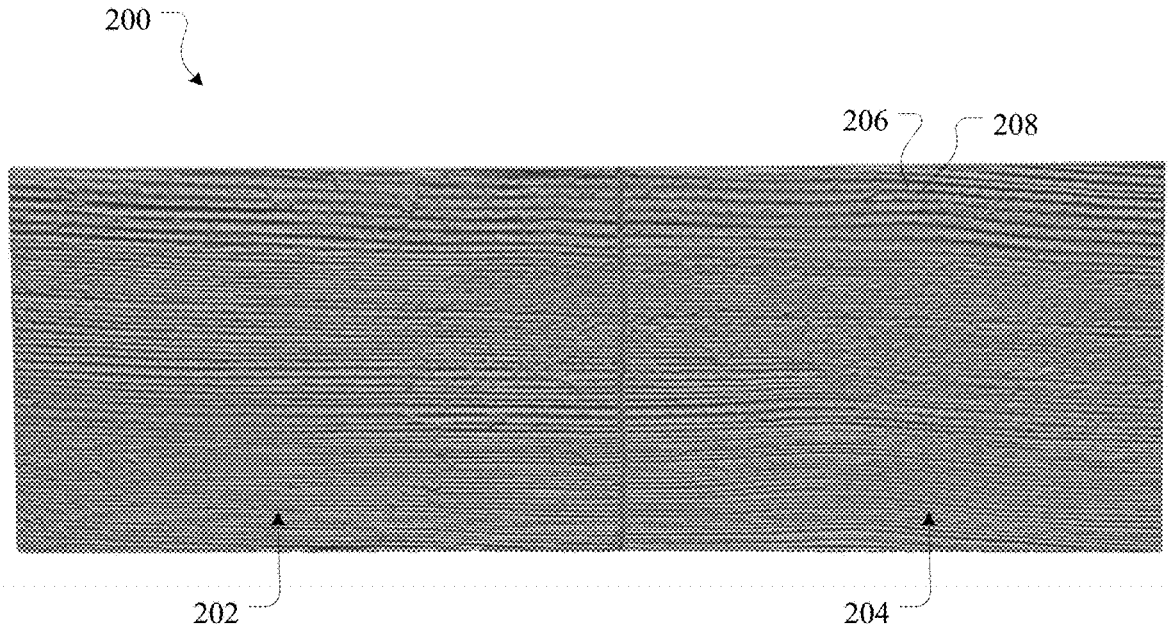
Figure 2C:
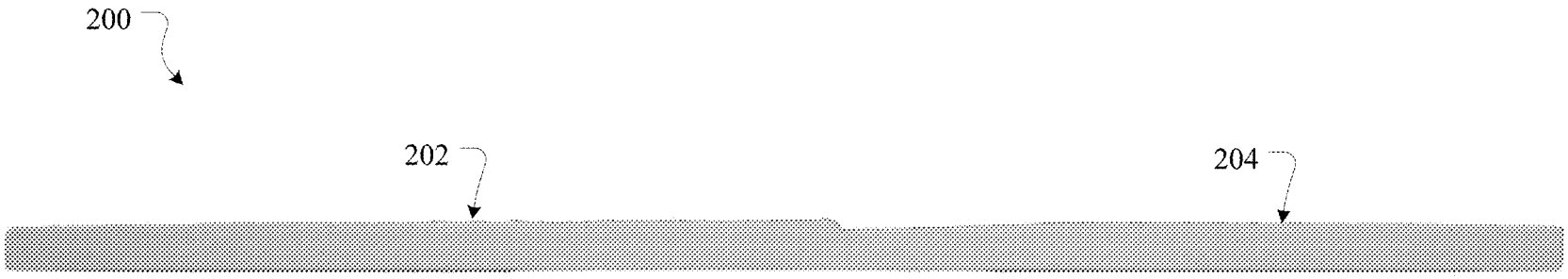
Figure 2D:
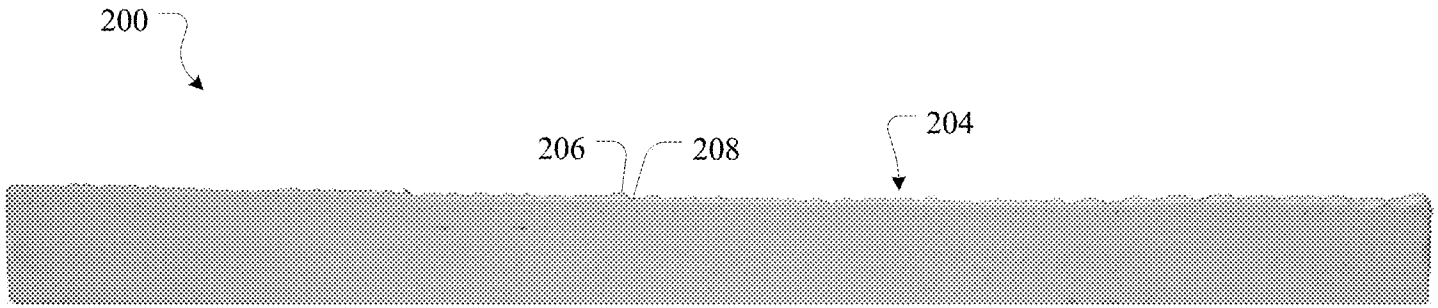

FIGS. 2A-2D depict an example shingle 200 with a texture of raised fibers that follow grain lines. FIG. 2A is a perspective view of the shingle 200, FIG. 2B is a front elevation view, FIG. 2C is a left side profile view, and FIG. 2D is a bottom plan view of the shingle 200. Similar to the shingle 100 of FIGS. 1A-1D, the shingle 200 is generally defined by an upper section 202 and a lower section 204 disposed below the upper section 202 when the shingle 200 is installed vertically against a building substrate. The shingle 200 includes a variety of peak areas 206 and valley areas 208 arranged in a shape approximating a series of raised fibers following grain lines, for example, as would appear in natural sawn cut cedar. As shown in FIG. 2D, the shingle 200 has a thickness at the peak areas 206 that is greater than a thickness of the shingle 200 at the valley areas 208. A difference between the thickness of the shingle 100 at the peak areas 206 and the thickness of the shingle 200 at the valley areas 208 can range from 0.045" to 0.085" (1.143 mm to 2.159 mm), for example, although differences outside these values or ranges are possible in some cases. The shingle 200 may comprise any cementitious material with or without fiber reinforcement, or other suitable cladding material, such as vinyl, a composite material, wood-based material, or the like. For example, the shingle 200 can comprise fiber cement.

Figure 3A:
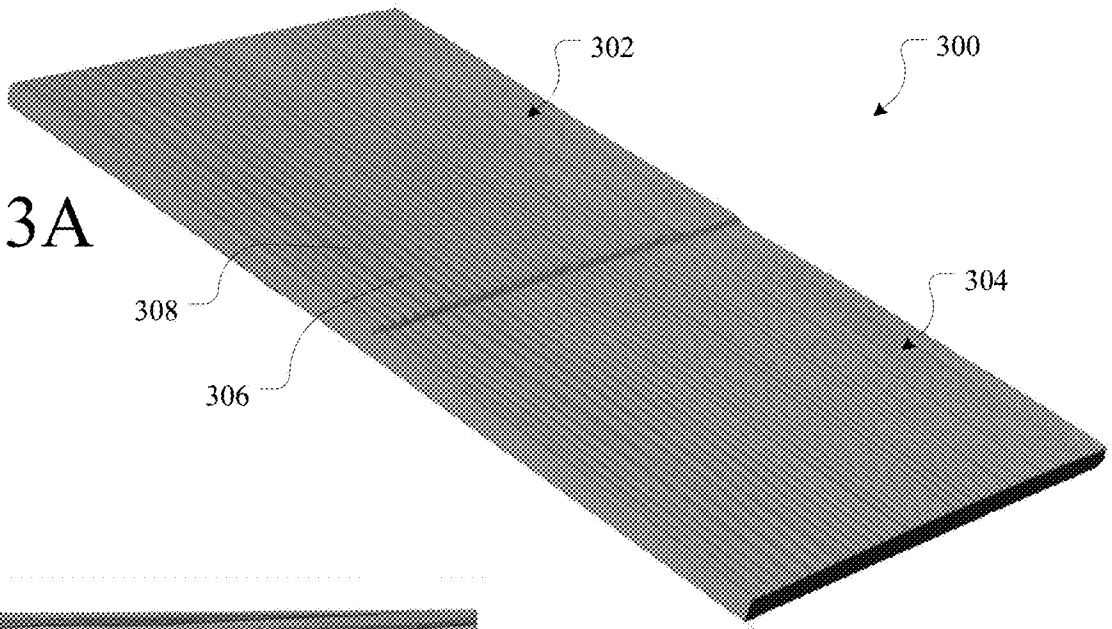
FIGS. 3A-3D depict a fiber cement article in accordance with one embodiment of the present disclosure.
Figure 3B:
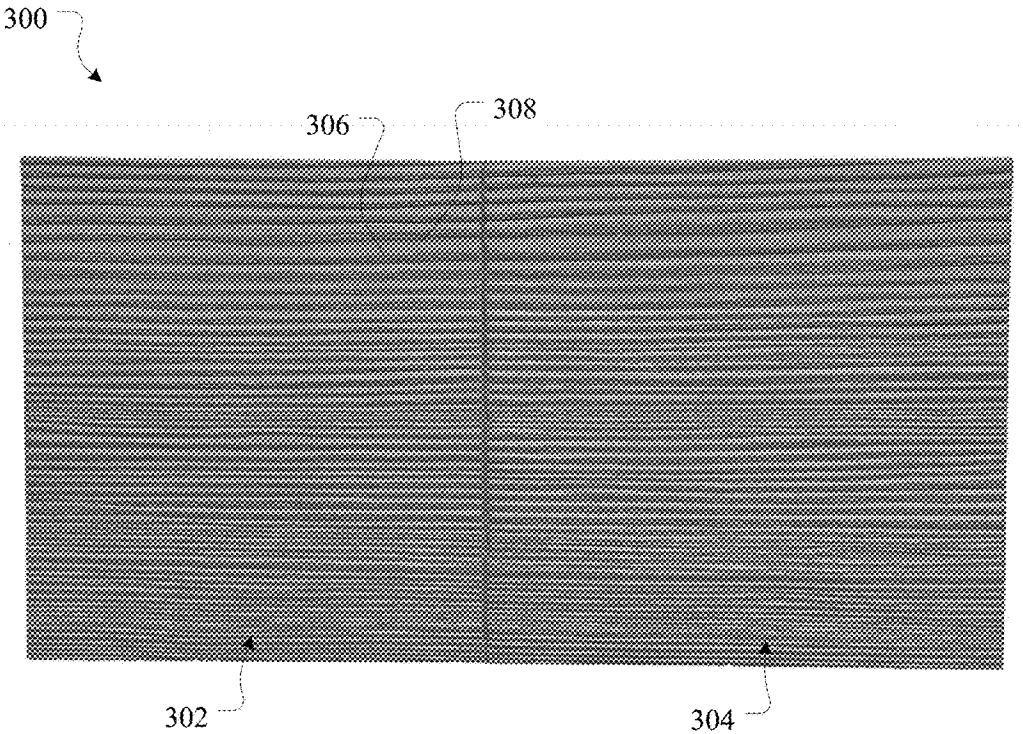
Figure 3C:
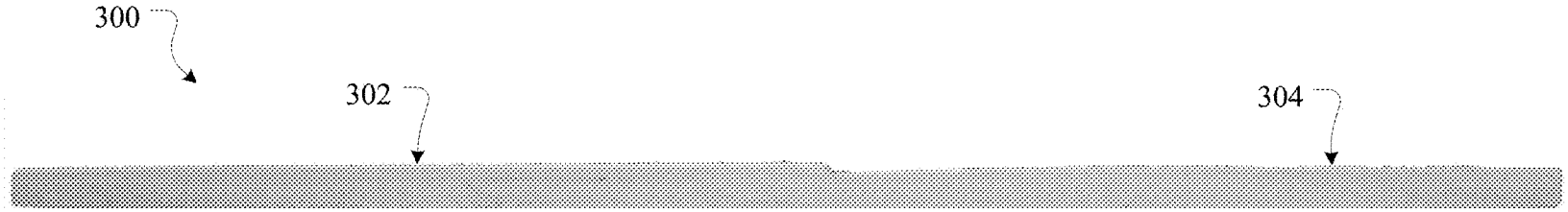
Figure 3D:
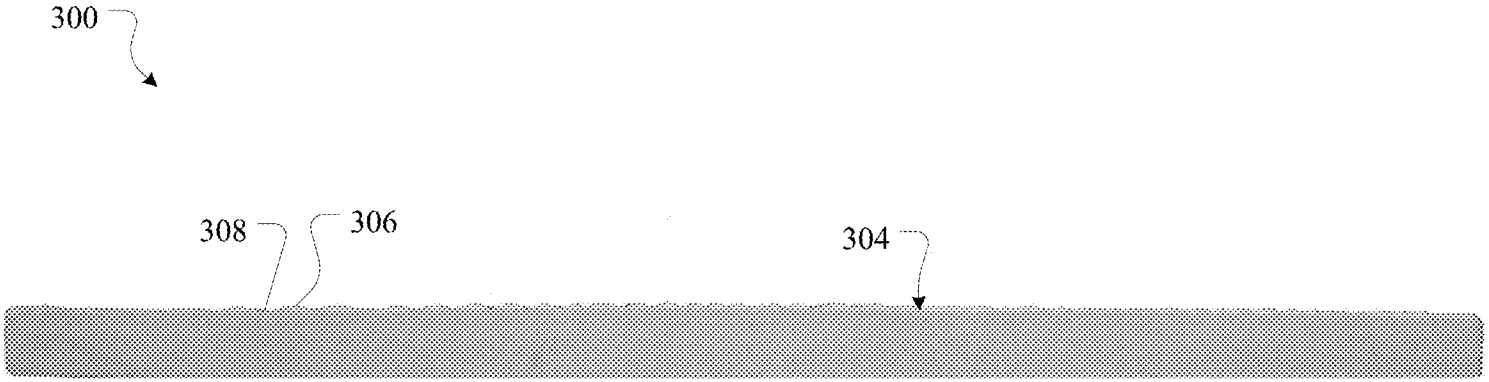

FIGS. 3A-3D depict an example shingle 300 with a straight grain, or edge grain, texture. FIG. 3A is a perspective view of the shingle 300, FIG. 3B is a front elevation view, FIG. 3C is a left side profile view, and FIG. 3D is a bottom plan view of the shingle 300. Similar to the shingles 100 and 200 of FIGS. 1A-2D, the shingle 300 is generally defined by an upper section 302 and a lower section 304 disposed below the upper section 302 when the shingle 300 is installed vertically against a building substrate. The shingle 300 includes a variety of peak areas 306 and valley areas 308 arranged in a shape approximating a series of straight or edge grain lines. As shown in FIG. 3D, the shingle 300 has a thickness at the peak areas 306 that is greater than a thickness of the shingle 300 at the valley areas 308. A difference between the thickness of the shingle 300 at the peak areas 306 and the thickness of the shingle 300 at the valley areas 308 can range from 0.045" to 0.085" (1.143 mm to 2.159 mm), for example, although differences outside these values or ranges are possible in some cases. The shingle 300 may similarly comprise any cementitious material with or without fiber reinforcement, or other suitable cladding material, such as vinyl, a composite material, wood-based material, or the like. For example, the shingle 300 can comprise fiber cement.

Figure 4A:
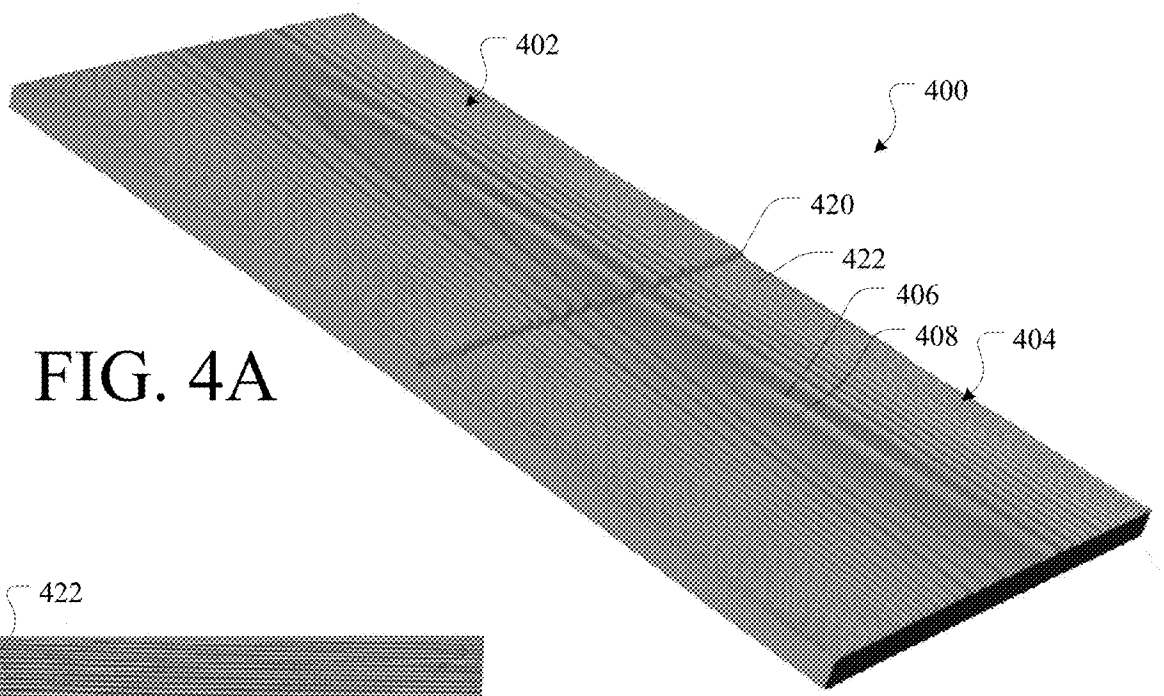
FIGS. 4A-4D depict a fiber cement article in accordance with one embodiment of the present disclosure.
Figure 4B:
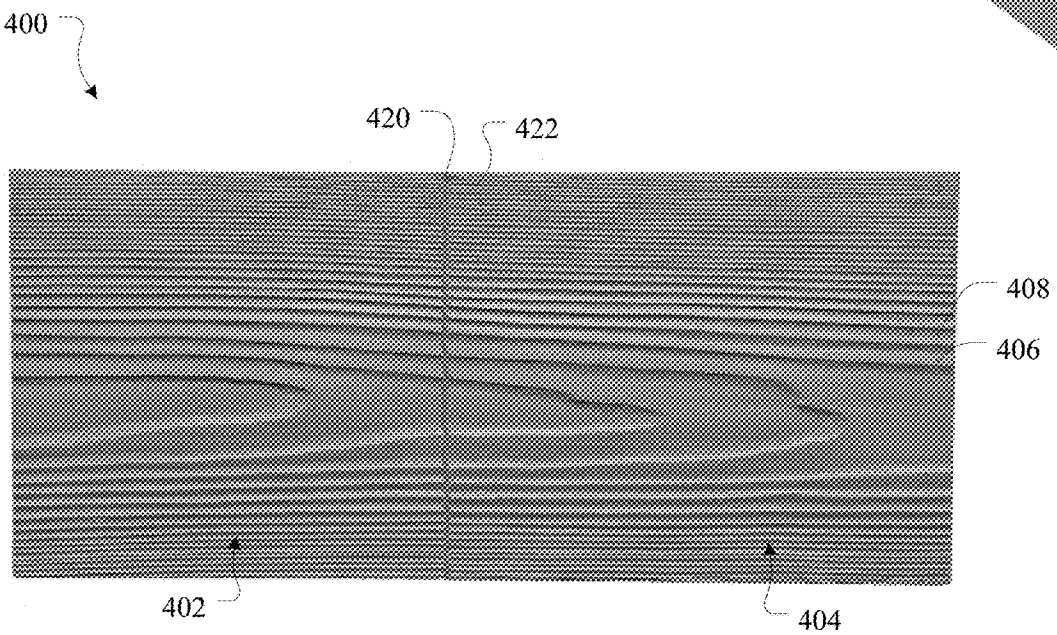
Figure 4C:
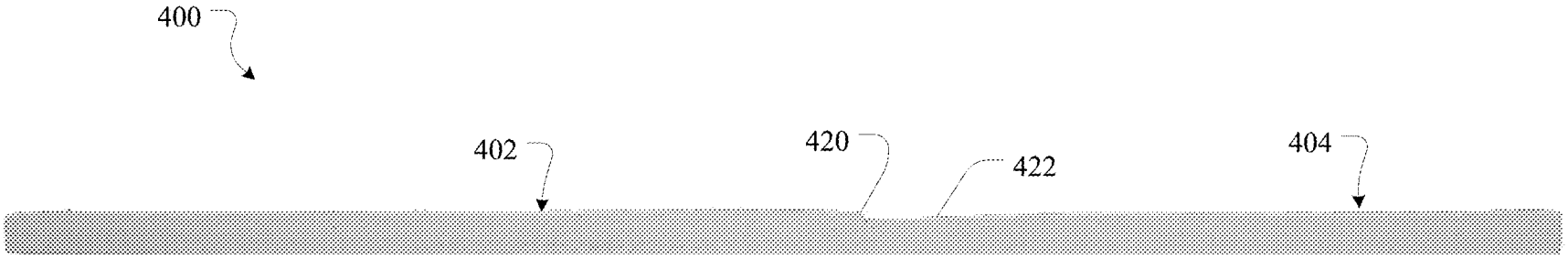
Figure 4D:
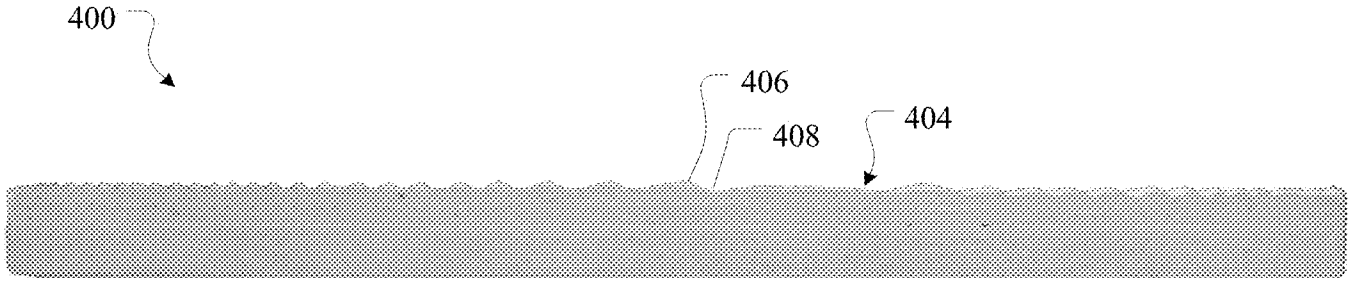

FIGS. 4A-4D depict an example shingle 400 with a cathedral texture. FIG. 4A is a perspective view of the shingle 400, FIG. 4B is a front elevation view, FIG. 4C is a left side profile view, and FIG. 4D is a bottom plan view of the shingle 400. The shingle 400 is generally defined by an upper section 402 and a lower section 404 disposed below the upper section 402 when the shingle 400 is installed vertically against a building substrate. The shingle 400 includes a variety of peak areas 406 and valley areas 408 arranged in a shape approximating a series of flat or open cathedrals. As shown in FIG. 4D, the shingle 400 has a thickness at the peak areas 406 that is greater than a thickness of the shingle 400 at the valley areas 408. A difference between the thickness of the shingle 400 at the peak areas 406 and the thickness of the shingle 400 at the valley areas 408 can range from 0.045" to 0.085" (1.143 mm to 2.159 mm), for example, although differences outside these values or ranges are possible in some cases. The shingle 400 may comprise any cementitious material with or without fiber reinforcement, or other suitable cladding material, such as vinyl, a composite material, wood-based material, or the like. For example, the shingle 400 can comprise fiber cement.

Figure 5A:
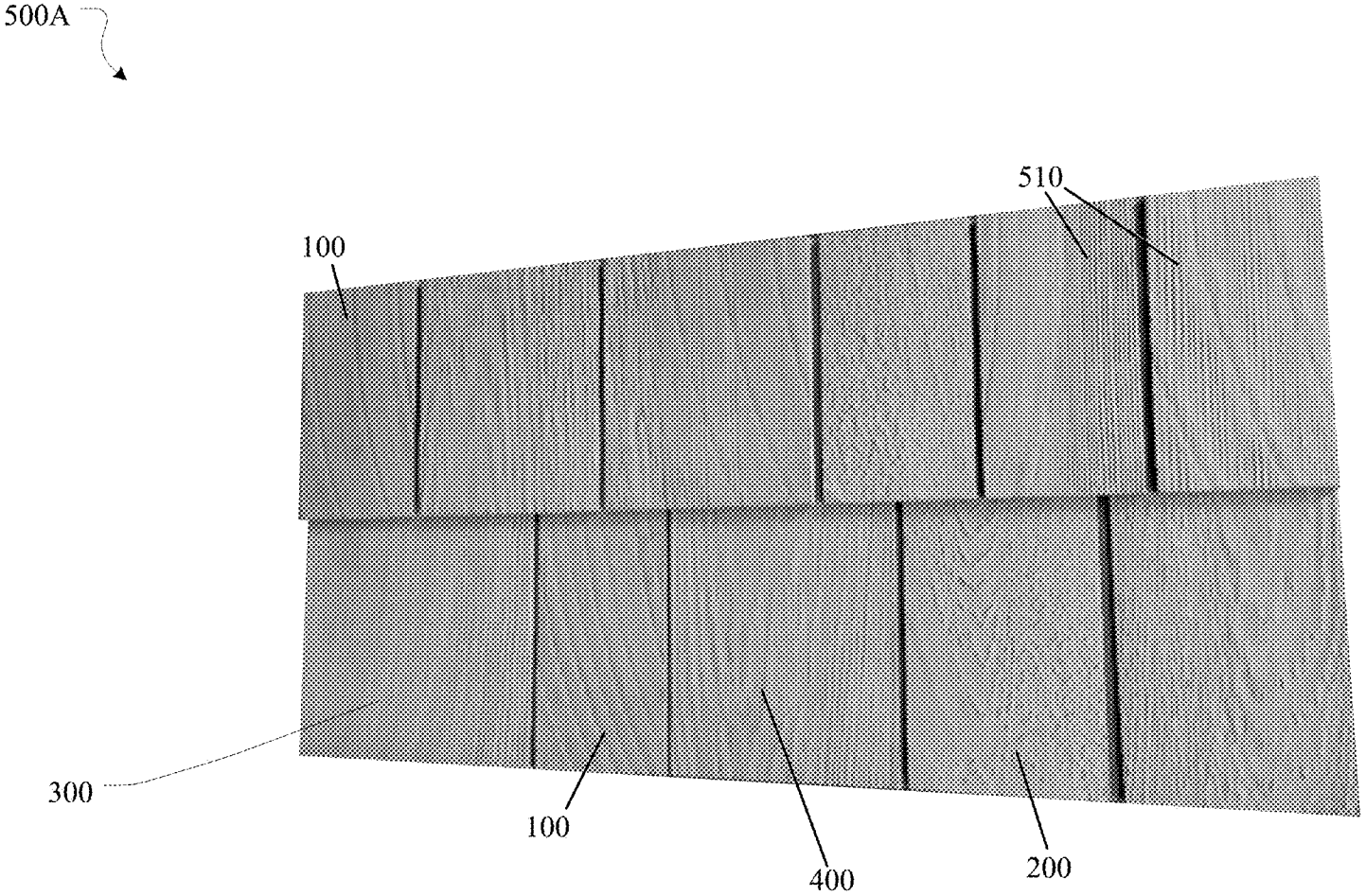
FIGS. 5A and 5B depict arrays of cementitious articles in accordance with one embodiment of the present disclosure exhibiting a combination of texture patterns to approximate the appearance of natural wood shingles.
Figure 5B:
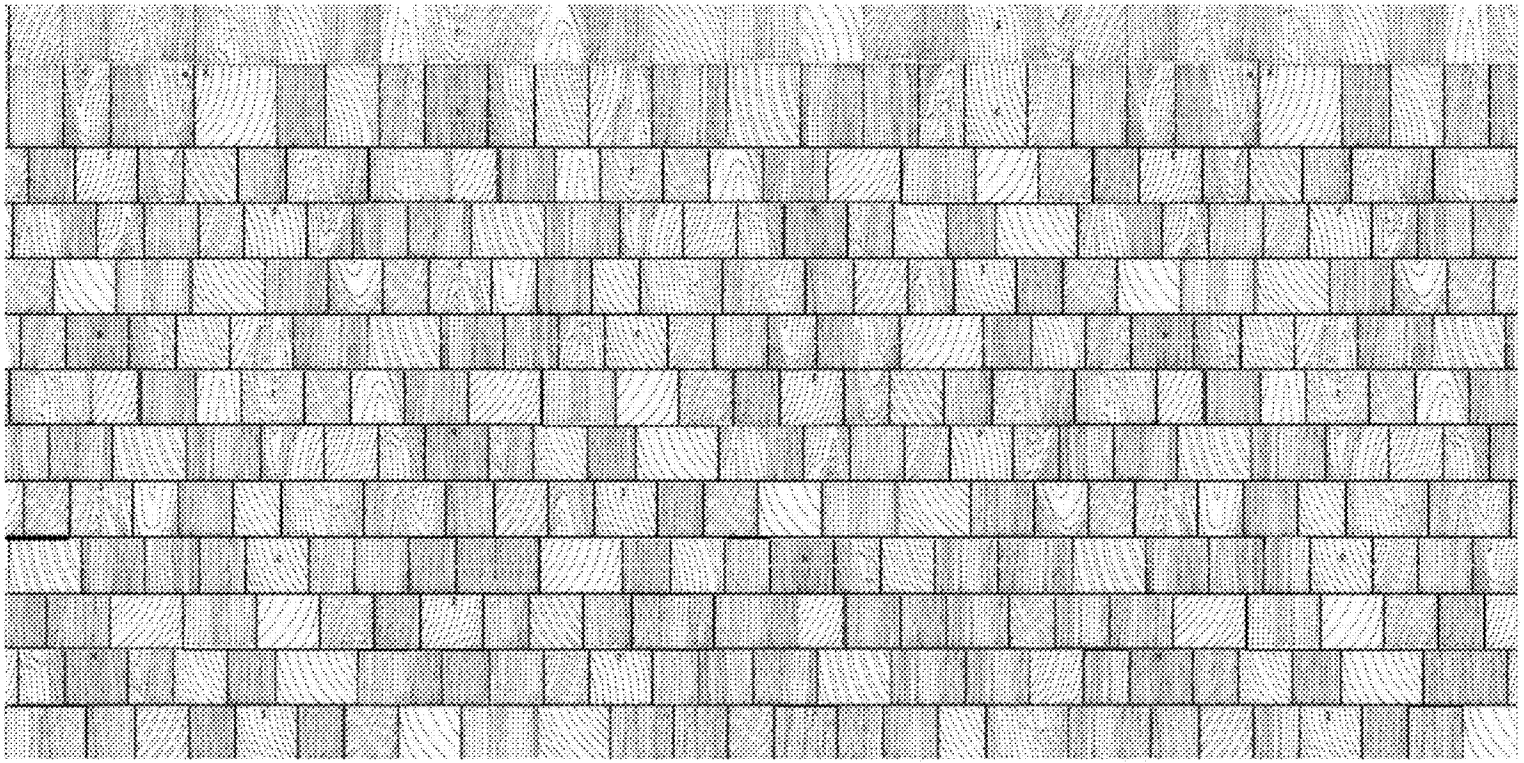

FIGS. 5A and 5B illustrate example combinations of textured shingles, for example, the shingles 100, 200, 300, 400 depicted in FIGS. 1A-4D, as installed on the exterior of a building as a cladding. FIG. 5A depicts a section 500A of a shingle cladding array (for example, a fiber cement shingle cladding array) illustrating an aesthetic advantageous effect of combining a plurality of different shingle textures in adjacent shingles. The section 500A includes shingles 100 with circular saw mark texture, shingles 200 with raised fiber texture, shingles 300 with straight or edge grain texture, and shingles 400 with cathedral texture. It will be appreciated that the exact arrangement of textural features (e.g., location, spacing, depth, orientation, etc.) may vary somewhat between examples of shingles of a particular texture, due to various manufacturing aspects (e.g., cutting shingles from a larger section of textured material).

The section 500A further includes shingle(s) 510 having a combination of the textures described above. For example, the shingle(s) 510 at the upper right corner of the section 500A include circular saw marks and straight or edge grain texture. Thus, the combination of shingles 100, 200, 300, 400, 510 in the section 500A appears to have a random or pseudo-random assortment consistent with the appearance of an example set of natural wood shingles.

In some embodiments, shingles 100, 200, 300, 400, 510 may be manufactured and installed in a row or section of shingles, rather than as individual shingles. For example, in the section 500A depicted in FIG. 5A, the lower row of shingles may comprise a single cementitious article connected by a contiguous strip at an upper portion of the article, such that the article may be installed to the building substrate as a single piece. After installation of the article, the upper row of shingles may be installed at least partially overlapping the one-piece lower row of shingles so as to conceal the contiguous strip.

In some embodiments, such a single-piece cementitious article may be manufactured in a strip, with keyways, or gaps, cut into a lower section of the strip to create the appearance of individual shingles. The keyways may extend less than the full height of the article to retain a contiguous strip across the length of the article. In some embodiments, the keyways cut into a single article may have a standard width, or may have variable widths within the same article to create the appearance of irregular shingle widths and/or spacing.

FIG. 5B depicts a larger section 500B of shingles as applied to a building substrate. The larger section 500B illustrates the aesthetic improvements that may be achieved by covering a wall with shingles having a random or pseudo-random variety of textures formed thereon. The combination of shingles shown in FIG. 5B, in which adjacent shingles may or may not have similar texture patterns, creates an appearance of natural sawn cut wood shingles. As will be described in greater detail below, this appearance may be enhanced by the use of a variety of coatings to approximate natural variation of wood shingles.

Cementitious Article Coatings

The color of the coatings provided herein may be described using CIELAB, a three-coordinate color space specified by the International Commission on Illumination. The three coordinates of CIELAB represent the lightness L of the color (L=0 yields black and L=100 indicates diffuse white; specular white may be higher), its position a between red/magenta and green (a ranges from −128 to +128, with negative values indicating green and positive values indicating magenta), and its position b between yellow and blue (b ranges from −128 to +128, with negative values indicating blue and positive values indicating yellow).

Alternatively, the color of the coatings described herein may be described using the RGB color model. A color in the RGB color model is described by indicating how much of each of the red, green, and blue is included. The color is expressed as an RGB triplet (R,G,B), each component of which can vary from zero to 255. An RGB triplet of (0,0,0) indicates black; an RGB triplet of (255, 255, 255) indicates the brightest representable white.

As described above, the overall coating system comprises a combination of the new cementitious article patterns with specifically designed basecoat and topcoat paint systems applied to them. In some embodiments, the waterborne coating system application process comprises: (1) application of a two-part waterborne epoxy sealer; (2) application of one or more solid basecoats; and (3) application of one or more topcoats. The basecoat and topcoat colors can be selected to simulate the appearance of natural wood including eastern grey cedar and western red cedar. In some embodiments, the topcoat is transparent or semi-transparent. In some embodiments, the topcoat is non-transparent.

In order to produce the natural look of cedar wood on a fiber cement article, both the texture pattern and the coating color system can be implemented in combination to create fiber cement shingle that looks like cedar wood shingle. The basecoat colors described herein are designed to match the majority of the natural cedar wood colors. For example, in embodiments configured to approximate eastern grey cedar, the basecoats can be light grey, grey (e.g., a medium grey), or dark grey in color. In embodiments configured to approximate western red cedar, the basecoats can be light tan, medium tan, or dark brown in color. Two or more of these basecoats may be combined to produce additional color configurations. Various example color specifications of these basecoats will now be described.

In some embodiments, the light grey basecoat has an L value of from about 74.38 to about 78.38, an a value of from about −1.77 to about 2.23, and a b value ranging from about 0.51 to about 4.51. In some embodiments, the light grey basecoat has an L value of from about 75.38 to about 77.38, an a value of from about −0.77 to about 1.23, and a b value ranging from about 1.51 to about 3.51. In some embodiments, the light grey basecoat has an L value of from about 75.88 to about 76.88, an a value of from about −0.27 to about 0.73, and a b value ranging from about 2.01 to about 3.01. In some embodiments, the light grey basecoat has an L value of about 76.38, an a value of about 0.23, and a b value of about 2.51.

In some embodiments, the light grey basecoat has an RGB triplet of about (177.97 to 181.97, 175.17 to 179.17, 170.39 to 174.39). In some embodiments, the light grey basecoat has an RGB triplet of about (178.97 to 180.97, 176.17 to 178.17, 171.39 to 173.39). In some embodiments, the light grey basecoat has an RGB triplet of about (179.47 to 180.47, 176.67 to 177.67, 171.89 to 172.89). In some embodiments, the light grey basecoat has an RGB triplet of about (179.97, 177.17, 172.39).

In some embodiments, the grey basecoat has an L value of from about 70.38 to about 74.38, an a value of from about −1.77 to about 2.23, and a b value ranging from about 0.51 to about 4.51. In some embodiments, the grey basecoat has an L value of from about 71.38 to about 73.38, an a value of from about −0.77 to about 1.23, and a b value ranging from about 1.51 to about 3.51. In some embodiments, the grey basecoat has an L value of from about 71.88 to about 72.88, an a value of from about −0.27 to about 0.73, and a b value ranging from about 2.01 to about 3.01. In some embodiments, the grey basecoat has an L value of about 72.38, an a value of about 0.23, and a b value of about 2.51.

In some embodiments, the grey basecoat has an RGB triplet of about (167.67 to 171.67, 164.40 to 168.40, 160.22 to 164.22). In some embodiments, the grey basecoat has an RGB triplet of about (168.67 to 170.67, 165.40 to 167.40, 161.22 to 163.22). In some embodiments, the grey basecoat has an RGB triplet of about (169.17 to 170.17, 165.90 to 166.90, 161.72 to 162.72). In some embodiments, the grey basecoat has an RGB triplet of about (169.67, 166.40, 162.22).

In some embodiments, the dark grey basecoat has an L value of from about 66.38 to about 70.38, an a value of from about −1.77 to about 2.23, and a b value ranging from about 0.51 to about 4.51. In some embodiments, the dark grey basecoat has an L value of from about 67.38 to about 69.38, an a value of from about −0.77 to about 1.23, and a b value ranging from about 1.51 to about 3.51. In some embodiments, the dark grey basecoat has an L value of from about 67.88 to about 68.88, an a value of from about −0.27 to about 0.73, and a b value ranging from about 2.01 to about 3.01. In some embodiments, the dark grey basecoat has an L value of about 68.38, an a value of about 0.23, and a b value of about 2.51.

In some embodiments, the dark grey basecoat has an RGB triplet of about (188.89 to 192.89, 186.06 to 190.06, 181.78 to 185.78). In some embodiments, the dark grey basecoat has an RGB triplet of about (189.89 to 191.89, 187.06 to 189.06, 182.78 to 184.78). In some embodiments, the dark grey basecoat has an RGB triplet of about (190.39 to 191.39, 187.56 to 188.56, 183.28 to 184.28). In some embodiments, the dark grey basecoat has an RGB triplet of about (190.89, 188.06, 183.78).

In some embodiments, the light tan basecoat has an L value of from about 60.81 to about 64.81, an a value of from about 10.35 to about 14.35, and a b value ranging from about 21.79 to about 25.79. In some embodiments, the light tan basecoat has an L value of from about 61.81 to about 63.81, an a value of from about 11.35 to about 13.35, and a b value ranging from about 22.79 to about 24.79. In some embodiments, the light tan basecoat has an L value of from about 62.31 to about 63.31, an a value of from about 11.85 to about 12.85, and a b value ranging from about 23.29 to about 24.29. In some embodiments, the light tan basecoat has an L value of about 62.81, an a value of about 12.35, and a b value of about 23.79.

In some embodiments, the light tan basecoat has an RGB triplet of about (184.86 to 188.86, 141.07 to 145.07, 108.38 to 112.38). In some embodiments, the light tan basecoat has an RGB triplet of about (185.86 to 187.86, 142.07 to 144.07, 109.38 to 111.38). In some embodiments, the light tan basecoat has an RGB triplet of about (186.36 to 187.36, 142.57 to 143.57, 109.88 to 110.88). In some embodiments, the light tan basecoat has an RGB triplet of about (186.86, 143.07, 110.38).

In some embodiments, the medium tan basecoat has an L value of from about 53.99 to about 57.99, an a value of from about 9.78 to about 13.78, and a b value ranging from about 17.71 to about 21.71. In some embodiments, the medium tan basecoat has an L value of from about 54.99 to about 56.99, an a value of from about 10.78 to about 12.78, and a b value ranging from about 18.71 to about 20.71. In some embodiments, the medium tan basecoat has an L value of from about 55.49 to about 56.49, an a value of from about 11.28 to about 12.28, and a b value ranging from about 19.21 to about 20.21. In some embodiments, the medium tan basecoat has an L value of about 55.99, an a value of about 11.78, and a b value of about 19.71.

In some embodiments, the medium tan basecoat has an RGB triplet of about (163.27 to 167.27, 124.05 to 128.05, 98.62 to 102.62). In some embodiments, the medium tan basecoat has an RGB triplet of about (164.27 to 166.27, 125.05 to 127.05, 99.62 to 101.62). In some embodiments, the medium tan basecoat has an RGB triplet of about (164.77 to 165.77, 125.55 to 126.55, 100.12 to 101.12). In some embodiments, the medium tan basecoat has an RGB triplet of about (165.27, 126.05, 100.62).

In some embodiments, the dark brown basecoat has an L value of from about 42.97 to about 46.97, an a value of from about 9.00 to about 13.00, and a b value ranging from about 17.00 to about 21.00. In some embodiments, the dark brown basecoat has an L value of from about 43.97 to about 45.97, an a value of from about 10.00 to about 12.00, and a b value ranging from about 18.00 to about 20.00. In some embodiments, the dark brown basecoat has an L value of from about 42.47 to about 43.47, an a value of from about 10.50 to about 11.50, and a b value ranging from about 18.50 to about 19.50. In some embodiments, the dark brown basecoat has an L value of about 44.97, an a value of about 11.00, and a b value of about 19.00.

In some embodiments, the dark brown basecoat has an RGB triplet of about (129.92 to 133.92, 95.08 to 99.08, 71.43 to 75.43). In some embodiments, the dark brown basecoat has an RGB triplet of about (130.92 to 132.92, 96.08 to 98.08, 72.43 to 74.43). In some embodiments, the dark brown basecoat has an RGB triplet of about (1131.42 to 132.42, 96.58 to 97.58, 72.93 to 73.93). In some embodiments, the dark brown basecoat has an RGB triplet of about (131.92, 97.08, 73.43).

The viscosity rheology and solids of the topcoats are formulated so that they adhere preferentially to the valley areas (e.g., valley areas 108, 208, 308, 408 of FIGS. 1A-4D) of the texture patterns as opposed to the peak areas (e.g., peak areas 106, 206, 306, 406 of FIGS. 1A-4D). The contrast in appearance and color of the coating system combination results from the differences in dry film thickness (DFT), solids, color between the topcoat and topcoat, as well as the preferential adherence of the topcoat to the valley regions of the shingle. Without these differences between the basecoat and topcoat, the final product may have a monochromatic color appearance and would not resemble natural or stained cedar wood.

In some embodiments provided herein, the topcoats were designed to enhance the new texture patterns and give visual contrast to the basecoat colors. Each basecoat color and/or combination of basecoat colors may be paired with a specific color topcoat to create a desired cedar wood look. In some embodiments, the topcoat may be light grey, grey (e.g., a medium grey), dark grey, or dark brown in color.

In some embodiments, the light grey topcoat has an L value of from about 71.70 to about 75.70, an a value of from about −3.27 to about 0.73, and a b value ranging from about −0.54 to about 3.46. In some embodiments, the light grey topcoat has an L value of from about 72.70 to about 74.70, an a value of from about −2.27 to about −0.27, and a b value ranging from about 0.46 to about 2.46. In some embodiments, the light grey topcoat has an L value of from about 73.20 to about 74.20, an a value of from about −1.77 to about −0.77, and a b value ranging from about 0.96 to about 1.96. In some embodiments, the light grey topcoat has an L value of about 73.70, an a value of about −1.27, and a b value of about 1.46.

In some embodiments, the light grey topcoat has an RGB triplet of about (177.82 to 181.82, 179.69 to 183.69, 176.36 to 180.36). In some embodiments, the light grey topcoat has an RGB triplet of about (178.82 to 180.82, 180.69 to 182.69, 177.36 to 179.36). In some embodiments, the light grey topcoat has an RGB triplet of about (179.32 to 180.32, 181.19 to 182.19, 177.86 to 178.86). In some embodiments, the light grey topcoat has an RGB triplet of about (179.82, 181.69, 178.36).

In some embodiments, the grey topcoat has an L value of from about 64.35 to about 68.35, an a value of from about −2.78 to about 1.22, and a b value ranging from about −0.84 to about 3.16. In some embodiments, the grey topcoat has an L value of from about 65.35 to about 67.35, an a value of from about −1.78 to about 0.22, and a b value ranging from about 0.16 to about 2.16. In some embodiments, the grey topcoat has an L value of from about 65.85 to about 66.85, an a value of from about −1.28 to about −0.28, and a b value ranging from about 0.66 to about 1.66. In some embodiments, the grey topcoat has an L value of about 66.35, an a value of about −0.78, and a b value of about 1.16.

In some embodiments, the grey topcoat has an RGB triplet of about (158.76 to 162.76, 159.64 to 163.64, 157.19 to 161.19). In some embodiments, the grey topcoat has an RGB triplet of about (159.76 to 161.76, 160.64 to 162.64, 158.19 to 160.19). In some embodiments, the grey topcoat has an RGB triplet of about (160.26 to 161.26, 161.14 to 162.14, 158.69 to 159.69). In some embodiments, the grey topcoat has an RGB triplet of about (160.76, 161.64, 159.19).

In some embodiments, the dark grey topcoat has an L value of from about 60.34 to about 64.34, an a value of from about −2.77 to about 1.23, and a b value ranging from about −0.93 to about 3.07. In some embodiments, the dark grey topcoat has an L value of from about 61.34 to about 63.34, an a value of from about −1.77 to about 0.23, and a b value ranging from about 0.07 to about 2.07. In some embodiments, the dark grey topcoat has an L value of from about 61.84 to about 62.84, an a value of from about −1.27 to about −0.27, and a b value ranging from about 0.57 to about 1.57. In some embodiments, the dark grey topcoat has an L value of about 62.34, an a value of about −0.77, and a b value of about 1.07.

In some embodiments, the dark grey topcoat has an RGB triplet of about (148.10 to 152.10, 149.04 to 153.04, 146.77 to 150.77). In some embodiments, the dark grey topcoat has an RGB triplet of about (149.10 to 151.10, 150.04 to 152.04, 147.77 to 149.77). In some embodiments, the dark grey topcoat has an RGB triplet of about (149.60 to 150.60, 150.54 to 151.5, 148.27 to 149.27). In some embodiments, the dark grey topcoat has an RGB triplet of about (150.10, 151.04, 148.77).

In some embodiments, the dark grey topcoat has an L value of from about 38.39 to about 42.39, an a value of from about 5.65 to about 9.65, and a b value ranging from about 10.51 to about 14.51. In some embodiments, the dark grey topcoat has an L value of from about 39.39 to about 41.39, an a value of from about 6.65 to about 8.65, and a b value ranging from about 11.51 to about 13.51. In some embodiments, the dark grey topcoat has an L value of from about 39.89 to about 40.89, an a value of from about 7.15 to about 8.15, and a b value ranging from about 12.01 to about 13.01. In some embodiments, the dark grey topcoat has an L value of about 40.39, an a value of about 7.65, and a b value of about 12.51.

In some embodiments, the dark grey topcoat has an RGB triplet of about (112.56 to 116.56, 88.27 to 92.27, 73.18 to 77.18). In some embodiments, the dark grey topcoat has an RGB triplet of about (113.56 to 115.56, 89.27 to 91.27, 74.18 to 76.18). In some embodiments, the dark grey topcoat has an RGB triplet of about (114.06 to 115.06, 89.77 to 90.77, 74.68 to 75.68). In some embodiments, the dark grey topcoat has an RGB triplet of about (114.56, 90.27, 75.18).

In some embodiments, the dark brown topcoat has an L value of from about 46.44 to about 50.44, an a value of from about 19.20 to about 23.20, and a b value ranging from about 26.01 to about 30.01. In some embodiments, the dark brown topcoat has an L value of from about 47.44 to about 49.44, an a value of from about 20.20 to about 22.20, and a b value ranging from about 27.01 to about 29.01. In some embodiments, the dark brown topcoat has an L value of from about 47.97 to about 48.94, an a value of from about 20.70 to about 21.70, and a b value ranging from about 27.51 to about 28.51. In some embodiments, the dark brown topcoat has an L value of about 48.44, an a value of about 21.20, and a b value of about 28.01.

In some embodiments, the dark brown topcoat has an RGB triplet of about (158.67 to 162.67, 98.27 to 102.27, 66.61 to 70.61). In some embodiments, the dark brown topcoat has an RGB triplet of about (159.67 to 161.67, 99.27 to 101.27, 67.61 to 69.61). In some embodiments, the dark brown topcoat has an RGB triplet of about (160.17 to 161.17, 99.77 to 100.77, 68.11 to 69.11). In some embodiments, the dark brown topcoat has an RGB triplet of about (160.67, 100.27, 68.61).

In some embodiments, the dark brown topcoat has an L value of from about 44.42 to about 48.42, an a value of from about 16.87 to about 20.87, and a b value ranging from about 23.42 to about 27.42. In some embodiments, the dark brown topcoat has an L value of from about 45.42 to about 47.42, an a value of from about 17.87 to about 19.87, and a b value ranging from about 24.42 to about 26.42. In some embodiments, the dark brown topcoat has an L value of from about 45.92 to about 46.92, an a value of from about 18.37 to about 19.37, and a b value ranging from about 24.92 to about 25.92. In some embodiments, the dark brown topcoat has an L value of about 46.42, an a value of about 18.87, and a b value of about 25.42.

In some embodiments, the dark brown topcoat has an RGB triplet of about (149.10 to 153.10, 95.08 to 99.08, 66.23 to 70.23). In some embodiments, the dark brown topcoat has an RGB triplet of about (150.10 to 152.10, 96.08 to 98.08, 67.23 to 69.23). In some embodiments, the dark brown topcoat has an RGB triplet of about (150.60 to 151.60, 96.58 to 98.58, 67.73 to 68.73). In some embodiments, the dark brown topcoat has an RGB triplet of about (151.10, 97.08, 68.23).

Dry film thickness (DFT) is the thickness of a coating as measured above the substrate. This can consist of a single layer or multiple layers. DFT is measured for cured coatings (after the coating dries). Thickness of a coating depends on the application and type of process employed. The DFT is often represented in mil (i.e., 0.001 inch).

In some embodiments provided herein, the DFT of the basecoat is from 0.1 to 2.0 mil. In some embodiments, the DFT of the basecoat is from 0.5 to 2.0 mil. In some embodiments, the DFT of the basecoat is from 1.0 to 2.0 mil. In some embodiments, the DFT of the basecoat is from 1.5 to 1.9 mil. In some preferred embodiments, the DFT of the basecoat is from 1.7 to 1.8 mil. In some embodiments provided herein, the DFT of the topcoat is from 0.1 to 2.0 mil. In some embodiments, the DFT of the topcoat is from 0.5 to 1.0 mil. In some embodiments, the DFT of the topcoat is from 0.6 to 0.9 mil. In some preferred embodiments, the DFT of the topcoat is from 0.7 to 0.8 mil.

In some embodiments, the DFT of the basecoat is from 1.0 to 2.0 mil and the DFT of the topcoat is from 0.1 to 2.0 mil. In some embodiments, the DFT of the basecoat is from 1.5 to 1.9 mil and the DFT of the topcoat is from 0.5 to 1.0 mil. In some embodiments, the DFT of the basecoat is from 1.7 to 1.8 mil and the DFT of the topcoat is from 0.7 to 0.8 mil. In some embodiments, the DFT of the topcoat is smaller than the DFT of the basecoat. In some embodiments, the DFT of the topcoat is a certain percentage of the DFT of the basecoat, for example, 20%, 30%, 40%, 50%, 60%, or 70% of the DFT of the basecoat. In some embodiments, the variation between the DFT of the topcoat relative to the DFT of the basecoat can help enhance an appearance of a manufactured building article better resemble natural wood.

The weight percent non-volatile material (NVM) is used in the coatings industry to describe the portion of a coating that remains as part of the cured film. In some embodiments provided herein, the basecoat has an NMV from 40 to 60 percent. In some embodiments provided herein, the basecoat has an NMV from 50 to 60 percent. In some embodiments provided herein, the topcoat has an NMV from 30 to 70 percent. In some embodiments provided herein, the topcoat has an NMV from 30 to 50 percent. In some embodiments provided herein, the topcoat has an NMV from 35 to 45 percent.

In some embodiments, the topcoat may comprise one or more UV absorbers (UVA). The UV absorber functions to absorb UV rays from the sunlight and dissipate them through the surface or the coating. In one embodiment, a UV absorber comprises 2-hydroxyphenyl-benzophenones, 2-(2-hydroxyphenyl)benzotriazole or 2-hydroxyphenyl-s-triazine, or a derivative thereof, however it is understood that any suitable UV absorber known to a person skilled in the art can also be used.

In some embodiments, the topcoat may comprise one or more Hindered Amine Light Stabilizer (HALS) additives. The HALS functions to neutralize photochemically produced free-radicals in the coating resin. In one embodiment, the at least one HALS can comprise di or oligo-functional HALS based on tetramethylpiperidine derivatives, however, it is understood that any suitable HALS known to a person skilled in the art can also be used.

An advantage of adding the at least one UV absorber and/or the at least one HALS is that each enhances the performance of a coating system of the present disclosure over time. In particular the at least one UV absorber and/or the at least one HALS prevent fade and enhance color retention while improving chalk resistance.

A system for installation of one or more building articles on a building substrate typically includes a relatively large number of building articles (for example, shingles). For example, a system for installation of one or more shingles on a building substrate can include tens or hundreds of shingles or more, and the one or more shingles can have a variety in colors that replicate the natural range of colors found in a particular type of wood. For example, in some embodiments, the shingle system replicates the natural range of colors found in eastern grey cedar or western red cedar.

As discussed above, the color of a shingle can be described using a CIELAB system and/or an RGB color model. As also discussed herein, a shingle can have one or more basecoats and one or more topcoats. The color of a shingle can be described using a color of one or more of the basecoats, one or more of the topcoats, and/or a combination of one or more basecoats and/or one or more topcoats. For example, a shingle can have a basecoat having a color value that can be described and/or classified using the CIELAB system (and/or an RGB color model) and/or a topcoat having a color value that can be described and/or classified using the CIELAB system (and/or an RGB color model). Further, a shingle having one or more basecoats and one or more topcoats can have a CIELAB or RGB color that combines and/or encompasses the individual CIELAB or RGB color values of each of the one or more basecoats and one or more topcoats.

The difference in color between shingles in a system or set can be described by the difference in the total color value (dE) between each shingle. The difference in color between shingles can be described as the difference between the CIELAB or RGB basecoat color values, the difference between the CIELAB or RGB topcoat color values, and/or the difference between an overall CIELAB or RGB color value for shingles, each of the overall shingle color values incorporating and/or combining the CIELAB or RGB basecoat and topcoat color values. For example, the difference in color between shingles can be described as a difference between the CIELAB or RGB values for the basecoats of the shingles. As another example, the difference in color between shingles can be described as a difference between the CIELAB or RGB values for the topcoats of the shingles. As another example, where a first shingle has a basecoat having a CIELAB or RGB value, a topcoat having a CIELAB or RGB value, and a combined CIELAB or RGB value which encompasses both, and where a second shingle has a basecoat having a CIELAB or RGB value, a topcoat having a CIELAB or RGB value, and a combined CIELAB or RGB value which encompasses both, a difference in color between the first shingle and the second shingle can be described as a difference (dE) between the combined CIELAB or RGB values for the first and second shingle.

The dE value between any two shingles can be determined by the formula $dE=[(L_2-L_1)^2+(a_2-a_1)^2+(b_2-b_1)^2]^{1/2}$ for the CIELAB system. The dE value between any two shingles can also be determined in a similar manner for the RGB system by the formula $dE=[(R_2-R_1)^2+(G_2-G_1)^2+(B_2-B_1)^2]^{1/2}$. These formulas can be used to describe the difference in color between basecoats in different shingles and/or topcoats in different shingles. Additionally, where two shingles each include one or more basecoats and one or more topcoats and a combined color value which encompasses both of the one or more basecoats and the one or more topcoats, these formulas can be used to describe the difference between these combined color values.

Generally, the colors in a set of shingles may be described by the minimum difference (dE) between adjacent shades, as well as by the difference (dE) between the most different shades in the set. In some embodiments, a minimum difference between the color values (dE) of any two shingles in a shingle system/set is from about 0.05 to about 10, for example, from about 0.2 to about 6, from about 0.1 to about 10, from about 0.2 to about 10, from about 0.3 to about 10, from about 0.4 to about 10, from about 0.5 to about 10, from about 0.6 to about 10, from about 0.7 to about 10, from about 0.8 to about 10, from about 0.9 to about 10, from about 1 to about 10, from about 2 to about 10, from about 3 to about 10, from about 4 to about 10, from about 5 to about 10, from about 6 to about 10, from about 7 to about 10, from about 8 to about 10, from about 9 to about 10, from about 2 to about 9, from about 3 to about 8, from about 4 to about 7, from about 5 to about 6, from about 0.05 to about 9, from about 0.05 to about 8, from about 0.05 to about 7, from about 0.05 to about 6, from about 0.05 to about 5, from about 0.05 to about 4, from about 0.05 to about 3, from about 0.05 to about 2, from about 0.05 to about 1, or from about 0.05 to about 0.5. In some embodiments, the dE between a shingle with a lowest color value and a shingle with a highest color value in a shingle system or set is from about 0.05 to about 10, for example, from about 0.2 to about 6, from about 0.1 to about 10, from about 0.2 to about 10, from about 0.3 to about 10, from about 0.4 to about 10, from about 0.5 to about 10, from about 0.6 to about 10, from about 0.7 to about 10, from about 0.8 to about 10, from about 0.9 to about 10, from about 1 to about 10, from about 2 to about 10, from about 3 to about 10, from about 4 to about 10, from about 5 to about 10, from about 6 to about 10, from about 7 to about 10, from about 8 to about 10, from about 9 to about 10, from about 2 to about 9, from about 3 to about 8, from about 4 to about 7, from about 5 to about 6, from about 0.05 to about 9, from about 0.05 to about 8, from about 0.05 to about 7, from about 0.05 to about 6, from about 0.05 to about 5, from about 0.05 to about 4, from about 0.5 to about 3, from about 0.05 to about 2, from about 0.05 to about 1, or from about 0.05 to about 0.5.

In some embodiments, a maximum difference dE between any two shingles in a set of shingles for installation on a single building substrate is 10, 9, 8, 7, 6, 5, 4, 3, 2, or 1, for example, and/or any two adjacent shingles can have a minimum dE of 0.05, 0.1, 0.2, 0.3, 0.4, 0.5, 0.6, 0.7, 0.8, 0.9, 1, 2, 3, or 4, for example. In some embodiments, there may be 4 different shades, for example, having color values E of n, n+2, n+4, and n+6. Moreover, the different shades may be applied randomly to the different shingle textures so as to provide an appearance of a large amount of variation between shingles as would be found, for example, in natural cedar shingle.

In one example, a set of shingles for installation on a single building substrate may have a minimum dE of 2 between adjacent shades, and may have a total overall dE of 6 between the lowest and highest color values in the set. In this example embodiment, there may be 4 different shades, for example, having color values E of n, n+2, n+4, and n+6. Moreover, the different shades may be applied randomly to the different shingle textures so as to provide an appearance of a large amount of variation between shingles as would be found, for example, in natural cedar shingle.

One of the reasons it is difficult to replicate the appearance of natural wood with manufactured building articles (for example shingles) is because the human eye can recognize repetitive patterns relatively well. Keeping the differences between color values of building articles in a system or set within values or ranges such as those described above can advantageously create a natural appearance of wood on building articles comprising non-wood material (for example, fiber cement), as discussed elsewhere herein.

As discussed above, the shingles disclosed herein can have a basecoat and a topcoat. The basecoat can have a color value, using the CIELAB system, having an L value, an a value, and a b value. Similarly, the topcoat can have a color value, using the CIELAB system, having an L value, an a value, and a b value. The dE value between the basecoat and the topcoat of a shingle can be determined by the formula $dE=[(L_2-L_1)^2+(a_2-a_1)^2+(b_2-b_1)^2]^{1/2}$ for the CIELAB system. The dE value between the basecoat and the topcoat of a shingle can be similarly determined where the basecoats and topcoat have RGB values by the formula $dE=[(R_2-R_1)^2+(G_2-G_1)^2+(B_2-B_1)^2]^{1/2}$. In some embodiments, the dE value between the basecoat and the topcoat can be selected so as to enhance an appearance of a manufactured shingle so as to resemble natural or stained cedar wood. For example, as shown in Table 2 below, a shingle can have a basecoat having a light grey color having an L value of 76.38, an a value of 0.23, and a b value of 2.51 and can have a topcoat having a light grey color having an L value of 73.70, an a value of −1.27, and a b value of 1.46. The difference dE between the basecoat and the topcoat in this example is 3.25. Similarly, the differences dE between the colors of basecoats and topcoats in other shingles in Table 2 and Table 4 can be determined. In some embodiments, the dE between a basecoat and a topcoat in a shingle can be between 3 and 7. In some embodiments, dE between a basecoat and a topcoat in a shingle can be at least 3 but no greater than 7. In some embodiments, the dE between a basecoat and a topcoat in a shingle can be between 8 and 18. In some embodiments, dE between a basecoat and a topcoat in a shingle can be at least 8 but no greater than 18. In some embodiments, the dE between a basecoat and a topcoat in a shingle can be between 1 and 3, between 3 and 20, between 3 and 15, or between 3 and 10.

In some embodiments, a manufactured shingle (for example, a fiber cement shingle) can have a topcoat having a DFT that is smaller than a DFT of the basecoat. For example, as shown in Tables 1 and 3, the topcoat can have a DFT of between 0.70 and 0.80 and the basecoat can have a DFT of between 1.70 and 1.80. As discussed above, the DFT of the topcoat can be a certain percentage of the DFT of the basecoat in some embodiments.

In some embodiments, a manufactured shingle (for example, a fiber cement shingle) can have a topcoat having a weight percent non-volatile material (NVM) that is smaller than a weight percent non-volatile material (NVM) of the basecoat. For example, the topcoat can have an NVM between 40% and 50% and the basecoat can have an NVM between 50% and 60%. In some embodiments, the basecoat can have a NVM that is greater than an NVM of the topcoat by 5%, 10%, 20%, 30%, 40%, or 50%. In some embodiments, the basecoat can have a NVM that is greater than an NVM of the topcoat by at least 5%, at least 10%, at least 20%, at least 30%.

Manufacturing a shingle with different topcoat/basecoat colors, DFT values, and/or NVM values can help the manufactured shingle have a more natural wood appearance as opposed to a monochromatic appearance.

EXAMPLES

Example 1: Basecoats and Topcoats for Eastern Gray Cedar Two-Tone Coating Specifications Example basecoat and topcoat specifications for an Eastern grey cedar two-tone coating process are presented below in Table 1. Each numbered topcoat was designed specifically for each numbered basecoat so that the basecoat/topcoat combinations created a stained look grey cedar appearance on the fiber cement shingle.

TABLE 1

Eastern cedar stain two-tone coating system specifications

| | Color | NVM % | WPG | pH | DFT (mil) |
|---|---|---|---|---|---|
| Basecoat | | | | | |
| 1 | Light grey | 55.8 | 10.51 | 8.8 | 1.70-1.80 |
| 2 | grey | 55.68 | 10.47 | 8.8 | 1.70-1.80 |
| 3 | Dark grey | 55.57 | 10.44 | 8.8 | 1.70-1.80 |
| Topcoat | | | | | |
| 1 | Light grey | 40.8 | 8.83 | 8.5-9.5 | 0.70-0.80 |
| 2 | grey | 40.8 | 8.83 | 8.5-9.5 | 0.70-0.80 |
| 3 | Dark grey | 40.8 | 8.83 | 8.5-9.5 | 0.70-0.80 |

In order to achieve the desired appearance of eastern grey stained cedar, the basecoat and topcoat color ranges are designed to have the CIELAB and RGB values provided in Table 2 below. The color range values are narrow so that the desired distinction between basecoat and topcoat combinations can be maintained once applied.

TABLE 2

Eastern cedar stain look two-tone color values. Maintaining the CIELAB color values within L +/− 0.50, a +/− 0.10 and b +/− 0.25 for the basecoat colors, and L +/− 0.50, a +/− 0.25 and b +/− 0.25 for the topcoat colors can help ensure that the appropriate overall color is achieved.

| | | CIELAB values | | | RGB Values | | |
|---|---|---|---|---|---|---|---|
| | Color | L | a | b | R | G | B |
| Basecoat | | | | | | | |
| 1 | Light grey | 76.38 | 0.23 | 2.51 | 179.97 | 177.17 | 172.39 |
| 2 | Grey | 72.38 | 0.23 | 2.51 | 169.67 | 161.64 | 162.22 |
| 3 | Dark grey | 68.38 | 0.23 | 2.51 | 190.89 | 188.06 | 183.78 |
| Topcoat | | | | | | | |
| 1 | Light grey | 73.70 | −1.27 | 1.46 | 179.82 | 181.69 | 178.36 |
| 2 | Grey | 66.35 | −0.78 | 1.16 | 160.76 | 166.40 | 159.19 |
| 3 | Dark grey | 62.34 | −0.77 | 1.07 | 150.10 | 151.04 | 148.77 |

Example 2: Basecoats and Topcoats for Western Red Cedar Two-Tone Coating Specifications The basecoat and topcoat specifications for the Western red cedar two-tone are presented below in Table 3. The three wood color basecoat for western red cedar were designed to match the most prevalent colors that occur naturally in red cedar. The topcoats were designed specifically for each wood color basecoat so that the basecoat/topcoat combinations create a stained look red cedar appearance on the fiber cement shingle. The impact of the new texture patterns aids significantly in creating a sawn cut wood appearance, and both the new shingle pattern and the new coating system colors are required to achieve the overall natural wood appearance.

TABLE 3

Western red cedar stain look two-tone coating system stain look two-tone coating system.

| | Color | NVM % | WPG | pH | DFT (mil) |
|---|---|---|---|---|---|
| Basecoat | | | | | |
| 1 | Light tan | 54.28 | 10.24 | 8.8 | 1.70-1.80 |
| 2 | Medium tan | 53.85 | 10.13 | 8.8 | 1.70-1.80 |
| 3 | Dark brown | 52.98 | 9.96 | 8.8 | 1.70-1.80 |

TABLE 3-continued

Western red cedar stain look two-tone coating system stain look two-tone coating system.

| | Color | NVM % | WPG | pH | DFT (mil) |
|---|---|---|---|---|---|
| Topcoat | | | | | |
| 1 | Dark brown | 46.90 | 9.90 | 9.5 | 0.70-0.80 |
| 2 | Dark brown | 46.90 | 9.90 | 8.5-9.5 | 0.70-0.80 |
| 3 | Dark grey | 40.80 | 8.83 | 8.5-9.5 | 0.70-0.80 |

In order to achieve the desired appearance of western red stained cedar, the basecoat and topcoat color ranges are designed to have the CIELAB and RGB values provided in Table 4 below. The color range values are narrow so that the desired distinction between basecoat and topcoat combinations can be maintained once applied.

TABLE 4

Western red cedar stain look two-tone coating system. Maintaining the CIELAB color values within L +/− 0.50, a +/− 0.50 and b +/− 0.50 for the basecoat colors, and L +/− 0.50, a +/− 0.50 and b +/− 0.50 for the topcoat colors can help ensure that the appropriate overall color is achieved.

| | | CIELAB values | | | RGB Values | | |
|---|---|---|---|---|---|---|---|
| | Color | L | a | b | R | G | B |
| Basecoat | | | | | | | |
| 1 | Light tan | 62.81 | 12.35 | 23.79 | 186.86 | 143.07 | 110.38 |
| 2 | Medium tan | 55.99 | 11.78 | 19.71 | 165.27 | 126.05 | 100.62 |
| 3 | Dark brown | 44.97 | 11.00 | 19.00 | 131.92 | 97.08 | 73.43 |
| Topcoat | | | | | | | |
| 1 | Dark brown | 48.44 | 21.20 | 28.01 | 160.67 | 100.27 | 68.61 |
| 2 | Dark brown | 46.42 | 18.87 | 25.42 | 151.10 | 97.08 | 68.23 |
| 3 | Dark grey | 40.39 | 7.65 | 12.51 | 114.56 | 90.27 | 75.18 |

Example 3: Eastern Grey Cedar Shingle System

The shingle systems presented below in Tables 5 and 6 were developed to replicate the color variation found in natural eastern grey cedar. The shingles below have varying L, a, and b values. Values for dE are referenced to shingle number 1 in each of the two systems provided.

TABLE 5

Eastern gray cedar shingle system.

| No. | Basecoat 1 | Basecoat 2 | Topcoat | L | a | b | dL | da | db | dE |
|---|---|---|---|---|---|---|---|---|---|---|
| 1 | Light grey | Light grey | Light grey | 70.13 | 0.49 | 2.66 | — | — | — | — |
| 2 | Light grey | Medium grey | Light grey | 66.66 | 0.54 | 2.78 | −3.47 | 0.05 | 0.12 | 3.47 |
| 3 | Light grey | Light grey | Medium grey | 65.06 | 0.78 | 2.35 | −5.04 | 0.29 | −0.31 | 5.06 |
| 4 | Light grey | Medium grey | Medium grey | 63.10 | 0.72 | 2.40 | −7.03 | 0.23 | −0.26 | 7.04 |

TABLE 6

Eastern gray cedar shingle system.

| No. | Basecoat 1 | Basecoat 2 | Topcoat | L | a | b | dL | da | db | dE |
|---|---|---|---|---|---|---|---|---|---|---|
| 1 | Light grey | Light grey | Light grey | 63.65 | 0.91 | 2.73 | — | — | — | — |
| 2 | Light grey | Medium grey | Light grey | 62.28 | 1.03 | 2.68 | −1.37 | 0.12 | −0.05 | 1.38 |
| 3 | Light grey | Light grey | Medium grey | 63.10 | 1.11 | 2.48 | −0.55 | 0.20 | −0.25 | 0.64 |
| 4 | Light grey | Medium grey | Medium grey | 60.18 | 1.30 | 2.46 | −3.47 | 0.39 | −0.27 | 3.50 |

The foregoing description of the preferred embodiments of the present disclosure has shown, described and pointed out the fundamental novel features of coating systems provided herein. The various devices, methods, procedures, and techniques described above provide a number of ways to carry out the described embodiments and arrangements. Of course, it is to be understood that not necessarily all features, objectives or advantages described are required and/or achieved in accordance with any particular embodiment described herein. Also, although the invention has been disclosed in the context of certain embodiments, arrangements and examples, it will be understood by those skilled in the art that the invention extends beyond the specifically disclosed embodiments to other alternative embodiments, combinations, sub-combinations and/or uses and obvious modifications and equivalents thereof. Accordingly, the invention is not intended to be limited by the specific disclosures of the embodiments herein.

What is claimed is:

1. A cladding system configured to be installed in courses on an exterior of a building structure, the system comprising:

a plurality of fiber cement shingles comprising:

a first fiber cement shingle comprising a first fiber cement substrate, said first fiber cement substrate having a textured surface comprising a circular saw mark pattern, wherein the textured surface has a depth of relief ranging from 0.045 inch (1.143 mm) to 0.085 inch (2.159 mm);

a second fiber cement shingle comprising a second fiber cement substrate, said second fiber cement substrate having a textured surface comprising raised fibers, wherein the textured surface has a depth of relief ranging from 0.045 inch (1.143 mm) to 0.085 inch (2.159 mm);

a third fiber cement shingle comprising a third fiber cement substrate, said third fiber cement substrate having a textured surface comprising straight or edge grain, wherein the textured surface has a depth of relief ranging from 0.045 inch (1.143 mm) to 0.085 inch (2.159 mm); and a fourth fiber cement shingle comprising a fourth fiber cement substrate, said fourth fiber cement substrate having a textured surface comprising flat or open cathedrals, wherein the textured surface has a depth of relief ranging from 0.045 inch (1.143 mm) to 0.085 inch (2.159 mm); and a coating system disposed on the textured surface of each of the fiber cement substrates of the fiber cement shingles, the coating system comprising:

a sealing agent, the sealing agent comprising a two-part waterborne epoxy sealer;

a basecoat disposed on a portion of the sealing agent, the basecoat comprising a first Dry Film Thickness (DFT) between 1 to 3 mils; and a topcoat disposed on a portion of the basecoat, the topcoat comprising:

a second Dry Film Thickness (DFT) between 0.5 to 1.5 mils, wherein the second DFT of the topcoat is smaller than the first DFT of the basecoat, wherein the topcoat enhances the basecoat and textured surface;

wherein the depth of relief on each of the fiber cement substrates in combination with the coating system cause varied color values within each of the fiber cement shingles and between one or more different ones of the fiber cement shingles.

2. The cladding system of claim 1, wherein the circular saw mark pattern comprises one or more circular saw marks having a diameter between 42" (106.68 cm) and 46" (116.84 cm).

3. The cladding system of claim 1, wherein the first DFT of the basecoat is between 1.70 to 1.80 mil and the second DFT of the topcoat is between 0.70 to 0.80 mil.

4. The cladding system of claim 1, wherein each of the plurality of fiber cement shingles comprises a CIELAB color value, at least two of the plurality of fiber cement shingles comprising CIELAB color values that differ by a difference dE, and wherein the difference dE is between 3 and 10.

5. The cladding system of claim 1, wherein:

the basecoat of each of the plurality of fiber cement shingles comprises a first CIELAB color value comprising an L value between 67 and 77, an a value between −0.50 and 0.8, and a b value between 2.0 and 3.1; and the topcoat of each of the plurality of fiber cement shingles comprises a second CIELAB color value comprising an L value between 61 and 75, an a value between −2.0 and −0.2, and a b value between 0.5 and 2.0;

wherein the plurality of fiber cement shingles are configured to replicate an appearance of Eastern grey cedar wood shingles.

6. The cladding system of claim 1, wherein:

the basecoat of each of the plurality of fiber cement shingles comprises a first CIELAB color value comprising an L value between 44 and 64, an a value between 10 and 13, and a b value between 18 and 25; and the topcoat of each of the plurality of fiber cement shingles comprises a second CIELAB color value comprising an L value between 39 and 50, an a value between 7.0 and 22.0, and a b value between 11 and 29;

wherein the plurality of fiber cement shingles are configured to replicate an appearance of Western red cedar wood shingles.

7. The cladding system of claim 1, wherein the basecoat has a weight percent non-volatile material (NVM) of between 50 and 60 percent and the topcoat has a weight percent non-volatile material (NVM) of between 40 and 50 percent.

8. The cladding system of claim 1, wherein the topcoat further comprises a UV absorber and a Hindered Amine Light Stabilizer (HALS) additive.

9. A cladding shingle configured to replicate an appearance of a natural wood shingle, the cladding shingle comprising a fiber cement substrate and further comprising:

a textured surface, the textured surface comprising a wood grain pattern having a depth of relief ranging from 0.045" to 0.085"; and a coating system disposed on the textured surface, the coating system comprising:

a sealing agent, the sealing agent comprising a two-part waterborne epoxy sealer;

a basecoat disposed on a portion of the sealing agent, the basecoat comprising:

a Dry Film Thickness (DFT) between 1 to 3 mils; and a first CIELAB color value comprising a first L value, a first a value, and a first b value; and a topcoat disposed on a portion of the basecoat, the topcoat comprising:

a Dry Film Thickness (DFT) between 0.5 to 1.5 mils, wherein the DFT of the topcoat is smaller than the DFT of the basecoat;

a second CIELAB color value comprising a second L value, a second a value, and a second b value;

a UV absorber; and a Hindered Amine Light Stabilizer (HALS);

wherein the first CIELAB color value of the basecoat and the second CIELAB color value of the topcoat differ by a difference dE, and wherein the first L value of the basecoat is greater than the second L value of the topcoat.

10. The cladding shingle of claim 9, wherein the wood grain pattern comprises circular saw marks.

11. The cladding shingle of claim 10, wherein the circular saw marks have a diameter between 42" (106.68 cm) and 46" (116.84 cm).

12. The cladding shingle of claim 9, wherein the DFT of the basecoat is between 1.70 to 1.80 mil and the DFT of the topcoat is between 0.70 to 0.80 mil.

13. The cladding shingle of claim 9, wherein the difference dE between the first CIELAB color value of the basecoat and the second CIELAB color value of the topcoat is between 3 and 7, and wherein:

the first L value is between 67 and 77 and the second L value is between 61 and 75, the first L value being greater than the second L value;

the first a value is between −0.5 and 1.0 and the second a value is between −2.0 and −0.2; and the first b value is between 2.0 and 3.0 and the second b value is between 0.5 and 2.0;

wherein the cladding shingle at least partially replicates an appearance of an Eastern grey cedar wood shingle.

14. The cladding shingle of claim 9, wherein the basecoat has a weight percent non-volatile material (NVM) of between 50 and 60 percent and the topcoat has a weight percent non-volatile material (NVM) of between 40 and 50 percent.

15. A building article having an appearance of wood, the building article comprising a fiber cement substrate having a textured surface and a coating system disposed on the textured surface, wherein the textured surface comprises a depth of relief, the depth of relief ranging from 0.010" (0.254 mm) to 0.300" (7.62 mm), and wherein the coating system comprises:

a basecoat, the basecoat comprising:

a first Dry Film Thickness (DFT) between 1 to 3 mils; and a first CIELAB color value comprising a first L value, a first a value, and a first b value;

a topcoat, the topcoat comprising:

a second Dry Film Thickness (DFT) between 0.5 to 1.5 mils, wherein the second DFT of the topcoat is smaller than the first DFT of the basecoat; and a second CIELAB color value comprising a second L value, a second a value, and a second b value;

wherein the first CIELAB color value of the basecoat and the second CIELAB color value of the topcoat differ by a difference dE, and wherein the first L value of the basecoat is greater than the second L value of the topcoat.

16. The building article of claim 15, wherein the textured surface of the fiber cement substrate comprises a textured pattern, the textured pattern comprising circular saw marks.

17. The building article of claim 15, wherein the coating system further comprises a sealing agent, the sealing agent comprising a two-part waterborne epoxy sealer.

18. The building article of claim 15, wherein the topcoat is semi-transparent.

19. The building article of claim 15, wherein the basecoat has a weight percent non-volatile material (NVM) of between 40 and 70 percent and the topcoat has a weight percent non-volatile material (NVM) of between 30 and 60 percent, and wherein the NVM of the basecoat is larger than the NVM of the topcoat.

20. The building article of claim 15, wherein the building article is a shingle.

* * * * *